US009540898B2

(12) United States Patent
Hughes

(10) Patent No.: US 9,540,898 B2
(45) Date of Patent: Jan. 10, 2017

(54) ANNULAR DRILLING DEVICE

(71) Applicant: SunStone Technologies, LLC, Oklahoma City, OK (US)

(72) Inventor: William James Hughes, Highland Ranch, CO (US)

(73) Assignee: Sunstone Technologies, LLC, Oklahoma City, OK (US)

( * ) Notice: Subject to any disclaimer, the term of this patent is extended or adjusted under 35 U.S.C. 154(b) by 0 days.

(21) Appl. No.: 14/719,120

(22) Filed: May 21, 2015

(65) Prior Publication Data

US 2015/0376970 A1 Dec. 31, 2015

Related U.S. Application Data

(60) Provisional application No. 62/017,645, filed on Jun. 26, 2014, provisional application No. 62/053,502, filed on Sep. 22, 2014.

(51) Int. Cl.
*E21B 33/03* (2006.01)
*E21B 33/08* (2006.01)

(52) U.S. Cl.
CPC ..... *E21B 33/085* (2013.01)

(58) Field of Classification Search
USPC ..... 166/84.1
See application file for complete search history.

(56) References Cited

U.S. PATENT DOCUMENTS

| | | | |
|---|---|---|---|
| 1,831,956 | A | 11/1931 | Harrington |
| 2,207,199 | A | 7/1940 | Hild |
| 2,243,439 | A | 5/1941 | Pranger et al. |
| 3,410,508 | A | 11/1968 | Fisher |
| 3,492,007 | A | 1/1970 | Jones |
| 4,073,352 | A | 2/1978 | Underwood |
| 4,095,656 | A | 6/1978 | French |
| 4,185,856 | A | 1/1980 | McCaskill |
| 4,448,255 | A | 5/1984 | Shaffer et al. |
| 4,949,785 | A | 8/1990 | Beard et al. |
| 5,062,479 | A | 11/1991 | Bailey et al. |
| 5,178,215 | A | 1/1993 | Yenulis et al. |
| 5,273,108 | A | 12/1993 | Piper |
| 5,279,365 | A | 1/1994 | Yenulis et al. |
| 5,507,465 | A | 4/1996 | Borle |
| 5,615,977 | A | 4/1997 | Moses et al. |
| 5,778,982 | A | 7/1998 | Hauck et al. |
| 5,848,643 | A | 12/1998 | Carbaugh et al. |
| 6,016,880 | A | 1/2000 | Hall et al. |

(Continued)

FOREIGN PATENT DOCUMENTS

| | | |
|---|---|---|
| AU | 2012202558 | 5/2012 |
| AU | 2014200241 | 1/2014 |

(Continued)

OTHER PUBLICATIONS

Official Action for U.S. Appl. No. 10/922,029, mailed May 2, 2006, 6 pages.

(Continued)

*Primary Examiner* — Taras P Bemko
(74) *Attorney, Agent, or Firm* — Sheridan Ross P.C.

(57) ABSTRACT

An annular drilling device is provided that employs an active or passive, stationary sealing element. The sealing element is made of a low-friction material that contacts the drill pipe and creates a seal.

25 Claims, 31 Drawing Sheets

(56) References Cited

U.S. PATENT DOCUMENTS

| | | | | |
|---|---|---|---|---|
| 6,024,172 | A | 2/2000 | Lee | |
| 6,109,348 | A | 8/2000 | Caraway | |
| 6,129,152 | A | 10/2000 | Hosie et al. | |
| 6,158,781 | A | 12/2000 | Aaron, III | |
| 6,227,547 | B1 | 5/2001 | Dietle et al. | |
| 6,230,748 | B1 | 5/2001 | Krawietz et al. | |
| 6,244,336 | B1 | 6/2001 | Kachich | |
| 6,470,975 | B1 | 10/2002 | Bourgoyne et al. | |
| 6,520,253 | B2 | 2/2003 | Calder | |
| 6,554,016 | B2 | 4/2003 | Kinder | |
| 6,626,245 | B1 | 9/2003 | Dallas | |
| 6,764,110 | B2 | 7/2004 | Russell | |
| 6,899,358 | B2 | 5/2005 | Richardson | |
| 7,040,394 | B2 | 5/2006 | Bailey et al. | |
| 7,080,685 | B2 | 7/2006 | Bailey et al. | |
| 7,380,590 | B2 | 6/2008 | Hughes et al. | |
| 7,445,030 | B2 | 11/2008 | Hardy et al. | |
| 7,743,823 | B2 | 6/2010 | Hughes et al. | |
| 7,766,100 | B2 | 8/2010 | Williams | |
| 7,798,210 | B1 | 9/2010 | Pruitt et al. | |
| 7,926,594 | B2 | 4/2011 | Williams | |
| 7,934,545 | B2 | 5/2011 | Bailey et al. | |
| 8,028,750 | B2 | 10/2011 | Hughes et al. | |
| 8,286,734 | B2 | 10/2012 | Hannegan et al. | |
| 8,500,337 | B2 | 8/2013 | Beauchamp et al. | |
| 8,631,874 | B2 | 1/2014 | Kozicz et al. | |
| 2002/0104660 | A1 | 8/2002 | Nice et al. | |
| 2005/0241833 | A1 | 11/2005 | Bailey et al. | |
| 2006/0037744 | A1* | 2/2006 | Hughes | E21B 33/085 166/85.4 |
| 2007/0199690 | A1 | 8/2007 | Williams | |
| 2009/0101333 | A1 | 4/2009 | Williams | |
| 2009/0139724 | A1 | 6/2009 | Gray et al. | |
| 2009/0321066 | A1* | 12/2009 | Scoggins | E21B 33/08 166/118 |
| 2012/0000664 | A1 | 1/2012 | Nas et al. | |
| 2013/0009366 | A1 | 1/2013 | Hannegan et al. | |
| 2014/0035238 | A1* | 2/2014 | Richie | F16J 15/441 277/559 |

FOREIGN PATENT DOCUMENTS

| | | |
|---|---|---|
| CN | 200949443 | 9/2007 |
| CN | 200955370 | 10/2007 |
| CN | 201155311 | 11/2008 |
| CN | 101761320 | 6/2010 |
| CN | 201574717 | 9/2010 |
| CN | 201943641 | 8/2011 |
| CN | 201963244 | 9/2011 |
| CN | 201963245 | 9/2011 |
| CN | 201963247 | 9/2011 |
| CN | 201972648 | 9/2011 |
| CN | 201972685 | 9/2011 |
| CN | 101182760 | 7/2012 |
| CN | 103015886 | 4/2013 |
| CN | 102108845 | 12/2013 |
| GB | 2503741 | 1/2014 |
| WO | WO 2009/029148 | 3/2009 |
| WO | WO 2012/127180 | 9/2012 |
| WO | WO 2013/037049 | 3/2013 |
| WO | WO 2014/006149 | 1/2014 |

OTHER PUBLICATIONS

Official Action for U.S. Appl. No. 10/922,029, mailed Oct. 12, 2006, 6 pages.

Official Action for U.S. Appl. No. 10/922,029, mailed Mar. 13, 2007, 6 pages.

Official Action for U.S. Appl. No. 10/922,029, mailed Aug. 31, 2007, 5 pages.

Notice of Allowance for U.S. Appl. No. 10/922,029, mailed Mar. 14, 2008 4 pages.

* cited by examiner 502
518
514
506
510
522
534
526
544
530
B
A
540

ANNULAR DRILLING DEVICE

This application claims the benefit of U.S. Provisional Patent Application Ser. No. 62/017,645, filed Jun. 26, 2014, and U.S. Provisional Patent Application Ser. No. 62/053,502, filed Sep. 22, 2014, the entire disclosure of which is incorporated by reference herein.

This application is also related to U.S. Pat. No. 7,380,590, titled "Rotating Pressure Control Head;" U.S. Pat. No. 7,743,823, titled "Force Balanced Rotating Pressure Control Device;" and U.S. Pat. No. 8,028,750, titled "Force Balanced Rotating Pressure Control Device," the entire disclosures of which are incorporated by reference herein.

FIELD OF THE INVENTION

Embodiments of the present invention are generally related to blowout preventers used in oil and gas wells, and specifically to an annular drilling device for both under-balanced and managed pressure drilling applications.

BACKGROUND OF THE INVENTION

Blowouts can occur when a column of mud in a wellbore weighs less than the formation pressure. More specifically, pressure within the wellbore will drastically increase when a formation expels hydrocarbon. The pressure increase sends a pressure wave up the wellbore to the surface that can damage the equipment that maintains the pressure within the wellbore. Besides the pressure wave, the hydrocarbons will travel up the wellbore because they are less dense than the mud. If hydrocarbons reach the surface and exit the wellbore through the pressure control stack (described below) before any of the components thereof are closed, there is a high probability that the drilling or production equipment will ignite the hydrocarbons. The resultant explosion or fire is dangerous and often deadly. To minimize blowout risk, drilling rigs must employ a plurality of different pressure control devices commonly referred to as a "pressure control stack," comprised of an annular pressure control device, also known as a Blowout Preventer ("BOP"), a pipe ram pressure control device, and a blind ram pressure control device. If a "closed loop drilling" method is used, a rotating pressure control device (also known as a Rotating Control Device) will be added on top of the conventional pressure control stack. Those of ordinary skill in the art know of other types of pressure control devices. The various pressure control devices are positioned on top of one another, with any other necessary surface connections, such as the choke and kill lines for managed pressure drilling applications and nitrogen injection lines for under-balanced drilling applications. One of skill in the art will appreciate that elimination of one or more pressure control devices in the stack would reduce the overall height thereof, which will provide smaller drilling rigs.

Again, one of the devices in the pressure control stack can be a rotating pressure control device, also referred to as a rotating pressure control head. The rotating pressure control head is located at the top of the pressure control stack and is part of the pressure boundary between the wellbore pressure and atmospheric pressure. The rotating pressure control head creates the pressure boundary by employing a ring-shaped (i.e., a torus) rubber or urethane sealing element that engages and squeezes against the drill pipe, tubing, casing, or other cylindrical members (hereinafter, "drill pipe"). The sealing element allows the drill pipe to be inserted into (i.e., stabbed) and removed from the wellbore while maintaining the pressure differential between wellbore pressure and atmospheric pressure. The sealing element may be shaped such that the wellbore pressure causes a portion of the sealing element to engage the drill pipe. However, some rotating pressure control heads utilizes a mechanism, typically energized with hydraulic fluid, to apply pressure to the outside of the sealing element which forces the inner portions of the sealing element against the drill pipe. The additional pressure applied to the sealing element allows the rotating pressure control head to be used for higher wellbore pressures. The sealing element is firmly engaged onto the rotating drill pipe and rotates with the drill pipe. Thus, outer portions of the sealing element are associated with several bearings and rotating seals that allow the sealing element to rotate.

The sealing element will eventually wear out because of friction caused by drill pipe rotation, reciprocation, and vibration. Additionally, the passage of pipe joints, down hole tools, and drill bits through the rotating pressure control head causes the sealing element to expand and contract repeatedly, which also causes sealing element wear. Other factors may also cause sealing element wear, such as extreme temperatures, dirt and debris, and rough handling. Sealing elements thus require frequent replacement. If a worn sealing element is not replaced, it may rupture, causing a loss of hydraulic fluids and control over the well head pressure.

Currently, visual inspections or time based life span estimates are used to determine when to replace a worn sealing element. Visual inspections are subjective, and may be unreliable. Time based estimates may not consider actual operating conditions. More specifically, if the time based estimate is too conservative, sealing elements are replaced too frequently, causing unnecessary expense and delay. If the time based estimate is too aggressive, the risk for rupture may be unacceptable. Typically, sealing elements are replaced daily at a significant cost as the time to replace the element is substantial.

U.S. Pat. No. 7,380,590 ("the '590 patent") discloses a Rotating Pressure Control Head ("RPCH") having a sealing element fixed in an inner housing where the inner housing is rotatably engaged to an outer housing by an upper bearing and a lower bearing. The RPCH of the '590 patent offers many improvements over the prior art including a shorter stack size, a quick release mechanism for inner housing and sealing element change out, and a reduction in harmonic vibrations. However, wellbore fluid pressure, pressurized hydraulic fluid, and pipe friction against the sealing element exert a net upward or downward force on the inner housing that translates into a load on the upper and lower bearings. The need of bearings to accommodate sealing element rotation adds complexity and expense to rotating pressure control heads. In addition, one or more seals are required to maintain operating pressure and to prevent fluid escape. As one of skill the art will appreciate, these components also increase system complexity and cost.

Those of skill in the art will appreciate that a drill pipe contained within the pressure control stack may bend or otherwise move, wherein the drill pipe will not be located in the center of the pressure control stack, the ideal location. For example, the weight of the drill pipe may cause it to bow or deflect within the pressure control stack. In addition, during offshore drilling operations, wave motion will cause a floating platform to move relative to the ocean floor, which can cause the drill pipe to move within the pressure control stack. Even if the platform is fixed, ocean currents and surges can move the drill casing, which can move the drill pipe. Movement of the drill pipe in the radial direction and away from the center of the pressure control stack may reduce the life of conventional rotating pressure control devices or annulars. For example, a misaligned drill pipe will contact the surfaces of the sealing member unevenly, thereby increasing wear in some areas. In addition, the drill pipe may move away from the sealing element or cause the sealing element to deflect in such a way to create a gap between the drill pipe and the sealing element, which can cause drilling fluid to expel from the pressure control stack.

Another drawback of existing pressure control stack is that it is difficult to interface with a static flowline. More specifically, pressure control stacks include a stack outlet that interconnects to a rigid flowline that receives downhole pressurized fluid. It is often difficult to mate the pressure control stack to the flowline as these components are rarely in the ideal location or alignment. Thus, mating is usually a labor-intensive process wherein plumbers and welders must modify the flowline to make the connection with the pressure control stack. Movement of the pressure control stack, which may be caused by external forces described above, will stress the connection between the pressure control stack outlet and the flowline. One of skill the art will also appreciate that when the pressure control stack, or components thereof, are replaced, the connection between the outlet and the flowline must be broken and reconnected. If a new outlet is not exactly where the old outlet was relocated, additional modifications will be needed.

It is a long felt need to provide a pressure control device that reduces system complexity and costs. The following disclosure describes a passive sealing element that does not require bearings, rotary seals, and the need to apply pressure to a sealing element.

SUMMARY OF THE INVENTION

It is an aspect of some embodiments of the present invention to provide an annular drilling device with a passive, i.e., non-moving, sealing element. More specifically, embodiments of the present invention include a housing that supports a sealing element that interfaces with an outer diameter of a drill pipe and remains stationary as the drill pipe rotates. Thus, the annular drilling device does not require bearings or other devices of prior art systems. The contemplated annular drilling device is simplified, smaller, lighter, less expensive, and easier to manufacture and maintain.

The sealing element may be maintained within the housing by way of a quick-released locking mechanism, which will be described in further detail below. In other embodiments, a quick release mechanism that provides access to the sealing element is not required as a sealing element is integrated or molded or bonded directly to the housing. When the integrated sealing element requires replacement, the drill pipe is disconnected, the housing is removed, a new housing with sealing element is added to the stack, and the drill pipe inserted into the wellbore, which further reduces complexity and downtime. The replaced housing is refurbished or recycled.

It is another aspect of embodiments of the present invention to provide a passive sealing element that does not require a dedicated system to supply external pressure. The passive seal may have an inner diameter less than the outer diameter of the drill pipe. In operation, the sealing element firmly engages the drill pipe. The inner surface of the sealing element may also generate an inward force that firmly engages the drill pipe. More specifically, some embodiments employ a sealing element with a lower end having an angled outer profile. For example, the sealing element may have a frusto-conical lower surface. Pressure within the wellbore will act against the angled surface, thereby generating and inward radial force that increases pressure of the sealing element on the drill pipe. Thus, some embodiments employ a sealing element that has an inner diameter larger than the outer diameter of the drill pipe, because the wellbore pressure will energize the sealing element to close the gap between the sealing element and the drill pipe. Wellbore pressure may be maintained if a small gap is present between the drill pipe and the sealing element because the rotating drill pipe will be exposed to drilling mud, or other externally-added lubricants, that form a sealing boundary layer that maintains wellbore pressure. This aspect also provides less resistance to drill pipe stabbing which reduces sealing element wear and tear.

To reduce frictional interactions between the rotating drill pipe and the stationary sealing element, some embodiments of the present invention include inner surfaces with protrusions or grooves. Lubricant is added to the sealing element, which is captured by the grooves to reduce friction when the drill pipe is inserted or rotating. The inner surface of the sealing element may have horizontal grooves, wavy grooves, dimples, etc.

It is another aspect of embodiments of the present invention to provide a sealing element that is easy to manufacture. More specifically, the sealing element may be made of a moldable material, such as urethane, which is durable and flexible. A sealing element made of urethane can flex, which allows the drill pipe to be stabbed therethrough and provides a tight engagement with the rotating drill pipe. To reduce friction, and increase sealing element life, the contemplated sealing element may be at least partially impregnated with oil, silicone, graphite, or other similar friction-reducing materials. Alternatively, the inner diameter of the sealing element may be coated with a friction-reducing material. Further, the sealing element may include one or more zones of impregnated material as opposed to the entire sealing element being impregnated The zones do not have to be continuous along the sealing element inner surface. For example, the inner surface may have horizontally oriented or coiled-shaped zones that extend at least a portion of the height of the inner surface. Also, similar to the protrusions described above, zones may be presented as spaced low-friction areas.

In some embodiments of the present invention, the annular drilling device has an active feature. More specifically, similar to the rotating pressure control device described in the '590 patent, embodiments of the present invention employ a stationary active seal. The sealing element may have a plurality of cavities that selectively receive pressurizing air or hydraulic fluid which energizes the sealing element and cause it to change shape. In one embodiment, the active sealing element is used to firmly engage against the drill pipe or to completely block the wellbore similar to an annular BOP. Those of skill in the art will appreciate that a pressure control device having this capability will allow the existing pressure control stack to omit an annular BOP, which decreases drilling costs, pressure control stack height, and system complexity. Alternatively, the annular drilling device having an active seal may replace the annular, wherein the pressure control stack may also employ a passive annular drilling device as described above. The active sealing element may be spaced from the drill string when not fully energized, thereby increasing seal life.

Those of skill in the art will also appreciate that conventional rotating pressure control devices generate heat as the drill string rotates, regardless of the presence of rotational bearings. And interactions between the rotating drill pipe and a stationary sealing element will also generate heat. As one of skill in the art will appreciate, excess heat will degrade the sealing element, degrade any lubricant added to the sealing element, or adversely affect the lubricating affects of drilling mud which further increases generated heat. Embodiments of the present invention address this issue by including a cooling system. For example, one embodiment employs a coil or other common heat dissipation device position about the housing's outer diameter. In operation, refrigerant or water is pumped through the coil and heat is drawn from the housing which may be used to generate electricity. After the heat energy is drawn from the water or refrigerant, it is directed back to the coil to complete the cycle. Some embodiments include housings with a plurality of integrated fluid tubes or bores. Furthermore, a blanket or insulating shield may be wrapped about the housing to reduce external heat exposure by blocking external heat sources.

It is another aspect of embodiments of the present invention to provide a sealing element that includes a wear indicator. More specifically, the concepts discussed in U.S. Pat. No. 7,743,823, which concern providing an electronic means for accessing seal wear, are applicable here. That is, the sealing element may include an embedded conductive strip or wire that indicates the point where the sealing element should be replaced. A conductive ring is positioned above the sealing element and in contact with the conductive strip. The conductive strip and conductive ring are isolated from the inner housing and other conductive surfaces. The conductive elements are, however, connected to a brush, or a stationary conductive member, that contacts an outer surface of the drill pipe. When the sealing element is worn a sufficient degree, the outer surface of the drill pipe will contact the embedded conductor to complete the circuit which will generate a signal.

In one embodiment, the annular drilling device is not entirely stationary, wherein the sealing element comprises an inner, rotating portion and an outer portion. The outer portion remains fixed to the housing wherein the inner portion grips and rotates with the drill pipe. A gap between the inner portion and the outer portion is filled with a lubricant, such as oil or drilling fluid. The outer surface of the inner portion may comprise a plurality of outwardly-extending protrusions, which may be in the shape of rings. The outwardly-extending rings may be received within corresponding grooves of the outer portion. The surface configuration of the inner portion and an outer portion create a plurality of journal bearings that reduce friction between the rotating inner portion and the fixed outer portion. Furthermore, the outwardly-extending protrusions may have an outer surface profile that mimics chevron seals that prevent drilling fluid from escaping the rotating annular drilling device through the gap. To maintain lubrication between the inner portion and an outer portion, some embodiments of the present invention allow for the continuous addition of oil or other lubricating materials. A visual indication of an unacceptable amount of weep would signal the gap between the inner portion and the outer portion has increased which warrants sealing element replacement.

It is another aspect of embodiments of the present invention to provide a quick release mechanism which provides access to the sealing element for inspection or replacement. More specifically, when the sealing element is in use, locking blocks are positioned in a radial groove or grooves in a block body associated with the housing. A control ring is provided that has several legs that extend to the block body that forces the lock blocks into the block groove.

It is another aspect of some embodiments of the present invention to provide an annular drilling device associated with articulating or flexible components. As discussed above, external forces can deflect the pressure control stack, which can adversely affect the life of the annular drilling device's sealing element. One way to address this problem is to compensate stack motion by allowing portions of the stack to move. The primary reason this has not been done is that most rotating pressure control devices include and outlet flange to reduce pressure control stack height. Height reduction is not as important as providing a pressure control stack that can articulate to maintain the sealing element generally centered which can extend the life of the sealing element. Thus one embodiment of the present invention is a pressure control device with a flexible coupling. The flexible coupling is interconnected below the annular drilling device wherein movements of the pressure control stack are compensated and the location and orientation of the drill pipe relative to the sealing element of the annular drilling device is maintained.

Another reason those of skill in the art have not provided an articulating pressure control stack is that the connection between the pressure control stack outlet and the flow line is rigid. This rigidity would adversely affect the functionality of a flexible coupling. Accordingly, one embodiment of the present invention addresses this issue by providing a flexible or compliant interconnection between the pressure control stack outlet and the flowline. The connection may comprise a spherical joint, flexible bellows, wire over-wrapped bellows, a rubberized joint, a Ball Strut Tie-Rod Assembly as used on the U.S. Space Shuttle and the Atlas V launch system and constructed by Arrowhead Products of Orange County, Calif., or other similar articulating devices may be used. An articulating joint between the outlet and the flowline will allow the pressure control stack outlet to move in at least three degrees of freedom. One of skill the art will appreciate that articulating joints of various types may be combined to allow for more movement of the outlet relative to the fixed flowline.

Further aspects of the present invention are provided in the following embodiments:

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring;

a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said outer profile has a frusto-conical section.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said inner profile has a protrusion or a groove.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said inner profile has an internal diameter that is less than that of the drill string.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said inner profile has an internal diameter that is greater than the drill string, said sealing element capable of assuming a second position of use wherein pressure is applied to decrease said internal diameter so that said sealing element firmly engages the drill pipe.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein bearings are not included.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, said sealing element further comprising: an outer portion that is fixed relative to said housing and an inner portion that engages the drill string and spins therewith.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, said sealing element further comprising: an outer portion that is fixed relative to said housing and an inner portion that engages the drill string and spins therewith, wherein said inner portion as at least one outwardly extending sealing profile.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, further comprising a cooling coil associated with said housing.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said sealing member is made of at least one of urethane, urethane impregnated with oil, urethane impregnated with Teflon, and urethane impregnated with graphite.

A pressure control device, comprising: a housing having an internal bore defined by an internal surface of a first diameter, said housing having an upper surface; a ring engaged onto said upper surface and interconnected to said housing, said ring having an internal surface with at least one locking groove; a block body position within said ring; a lock block operatively associated with said block body, said lock block body having a first position of use adjacent to said block body, and a second position of use biased away from said block body and into said locking groove; a control ring selectively interconnected to said block body; a sealing element having an outer profile that fits within said internal bore, and an inner profile that is adapted to receive a portion of a drill string; and wherein said sealing element is fixed in relation to said housing when the portion of the drill string is rotating, wherein said sealing element includes at least one cavity that selectively receives fluid to alter the shape of said sealing element.

A pressure control device, comprising: a housing having an internal bore defined by an internal surface of a first diameter; a sealing element having an outer profile that fits within said internal bore, and an inner profile that is adapted to receive a portion of a drill string; wherein said sealing element is fixed in relation to said housing when the portion of the drill string is rotating.

Further aspects of the present invention are provided in the following embodiments:

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the inner profile includes a plurality of inwardly-extending protrusions.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the inner profile includes a plurality of inwardly-extending protrusions, wherein the plurality of inwardly-extending protrusions are comprised of at least one of sinusoidal ridges, equally spaced rings, and dimples.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the inner profile includes a plurality of features formed in the compliant member.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the inner profile includes a plurality of features formed in the compliant member, wherein the plurality of features are comprised of at least one of a plurality of sinusoidal grooves, parallel grooves, and dimples.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the pressure control device is devoid of bearings and rotating seals.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the compliant member is made of at least one of urethane and urethane impregnated with at least one of oil, silicone, or graphite.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the compliant member has an internal surface that is coated with a friction-reducing material.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the cylindrical portion has a diameter greater than a diameter of the cylindrical member.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the housing includes a quick disconnect coupling at the second end.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the sealing element comprises an inner portion for engagement with the cylindrical member, wherein the inner portion rotates with the cylindrical member and the outer portion remains fixed relative to the housing.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the sealing element comprises an inner portion for engagement with the cylindrical member, wherein the inner portion rotates with the cylindrical member and the outer portion remains fixed relative to the housing, wherein the inner portion has a plurality of circumferential protrusions that operatively engage corresponding grooves in the outer portion.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, further comprising a fluid delivery coil positioned about the housing; and a heat exchanger associated with the fluid delivery coil.

A pressure control device, comprising: a housing having a first end and a second end, the first end having a first flange, the housing having an opening therethrough; a sealing element positioned within the housing and interconnected to a block body that is associated with the first flange, the sealing element being a compliant member possessing a distal end with a conical outer profile, and an inner profile with a cylindrical portion, the inner profile also including an opening adapted to selectively engage a cylindrical member, wherein the cylindrical portion has a diameter that is less than an outer diameter of the cylindrical member; and wherein the sealing element remains stationary relative to the housing, wherein the housing includes a wall with an integrated helical coil; and a heat exchanger associated with the helical coil.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses a distal end with a conical outer profile.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion, wherein the inner profile has a diameter that is less than an outer diameter of the cylindrical member.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion, wherein the inner profile includes a plurality of inwardly-extending protrusions.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion, wherein the inner profile includes a plurality of inwardly-extending protrusions, wherein the plurality of inwardly-extending protrusions are comprised of at least one of sinusoidal ridges, spaced rings, and dimples.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion, wherein the inner profile includes a plurality of indentations.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element possesses an inner profile with a cylindrical portion, wherein the inner profile includes a plurality of indentations, wherein the indentations are comprised of at least one of a plurality of sinusoidal grooves and dimples.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the pressure control device devoid of bearings and rotating seals.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element is interconnected to a block body that is adapted to interconnect to a housing flange at the first end.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element is interconnected to a block body that is adapted to interconnect to a housing flange at the first end, wherein the block body includes a cylindrical member embedded in the sealing element.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element is made of at least one of urethane and urethane impregnated with at least one of oil, silicone, or graphite.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element has an internal surface that is coated with a friction-reducing material.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element is directly integrated with the housing.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the second end of the housing includes a quick disconnect coupling.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element comprises an inner portion for engagement with the cylindrical member, wherein the inner portion rotates with the cylindrical member and the outer portion remains fixed relative to the housing.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the sealing element comprises an inner portion for engagement with the cylindrical member, wherein the inner portion rotates with the cylindrical member and the outer portion remains fixed relative to the housing, wherein the inner portion has a plurality of circumferential protrusions that operatively engage corresponding grooves in the outer portion.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, further comprising a coil positioned about the housing; and a heat exchanger associated with the coil.

A pressure control device, comprising: a housing having a first end and a second end, the housing having an opening therethrough; a sealing element maintained within the housing, the sealing element having an opening therethrough that is adapted to selectively engage a cylindrical member; and wherein the sealing element remains static relative to the housing, wherein the housing includes a wall with a coil; and a heat exchanger associated with the coil.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the second profile is cylindrical.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the second profile is cylindrical, wherein the second profile has a diameter that is less than the outer diameter of the portion of a drill string.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the internal wall includes a plurality of inwardly-extending protrusions.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the internal wall includes a plurality of inwardly-extending protrusions, wherein the plurality of inwardly-extending profiles are comprised of at least one of sinusoidal ridges, spaced rings, and dimples.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the internal wall includes a plurality of features formed in the internal wall.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the internal wall includes a plurality of features formed in the internal wall, wherein the features are comprised of at least one of sinusoidal grooves, and dimples.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the sealing element is a compliant member made of urethane.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the sealing element is a compliant member made of urethane, wherein the urethane is impregnated with at least one of oil, silicone, or graphite.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, wherein the sealing element is a compliant member made of urethane, wherein the urethane is impregnated with at least one of oil, silicone, or graphite.

A sealing element for a pressure control device, comprising: a member adapted for interconnection to a housing of the pressure control device; a first portion interconnected to the member; a second portion having a frusto-conical profile interconnected to the first portion; an opening extending through the member, the first portion, and the second portion, the opening adapted to receive a portion of a drill string; and wherein the opening defines an internal wall having a first profile and a second profile, further comprising an inner portion for engagement with the cylindrical element, wherein the inner portion rotates with the cylindrical element and the outer portion remains fixed relative to the cylindrical element.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element has a distal end with a conical outer profile.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element has an inner profile with a cylindrical portion.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element has an inner profile with a cylindrical portion, wherein the inner profile includes a plurality of inwardly-extending protrusions.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element has an inner profile with a cylindrical portion, wherein the inner profile includes a plurality of features formed in the sealing member.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the annular drilling device is devoid of bearings and rotating seals.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element is made of at least one of urethane and urethane impregnated with at least one of oil, silicone, or graphite.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element is directly integrated onto an inner surface of the opening of the housing.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the annular drilling device includes a quick disconnect coupling at its second end for interconnection to the first flexible coupling.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the spool includes a quick disconnect coupling at its first end for interconnection to the first flexible coupling.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the second flexible coupling is at least one of a flexible bellows, a spherical joint, a rubber joint, and a flexible conduit.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element comprises an inner portion for engagement with the cylindrical member, wherein the inner portion rotates with the cylindrical member and the outer portion remains fixed relative to the housing.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the sealing element comprises an inner portion for engagement with the cylindrical member, wherein the inner portion rotates with the cylindrical member and the outer portion remains fixed relative to the housing, wherein the inner portion has a plurality of circumferential protrusions that operatively engage corresponding grooves in the outer portion.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, further comprising a fluid delivery coil positioned about the housing; and a heat exchanger associated with the fluid delivery coil.

A pressure control stack, comprising: an annular drilling device with a passive sealing member, the annular drilling device comprising: a housing having a first end and a second end, the housing having an opening therethrough; a sealing element maintained within the housing; the sealing element having an opening therethrough that is adapted to selectively engage a cylindrical member; and wherein the sealing element remains static relative to the housing; a first flexible coupling interconnected to the annular drilling device; and a spool interconnected to the flexible coupling, the spool having an outlet operatively interconnected to a flow line by way of a second flexible coupling, wherein the housing includes a wall with a helical coil; and a heat exchanger associated with the helical coil.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element has a distal end with a conical outer profile.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element has an inner profile with a cylindrical portion.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element has an inner profile with a cylindrical portion, wherein the inner profile includes a plurality of inwardly-extending protrusions.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element has an inner profile with a cylindrical portion, wherein the inner profile includes a plurality of features formed in the sealing member.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the annular drilling device is devoid of bearings and rotating seals.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element is made of at least one of urethane and urethane impregnated with at least one of oil, silicone, or graphite.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the sealing element is directly integrated onto an inner surface of the opening of the housing.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device includes a quick disconnect coupling at its second end for interconnection to the first flexible coupling.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the spool includes a quick disconnect coupling at its first end for interconnection to the first flexible coupling.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the second flexible coupling is at least one of a flexible bellows, a spherical joint, a rubber joint, and a flexible conduit.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the first flexible coupling comprises an upper tube and a lower tube that are in communication with a transition ring, wherein the annular drilling device is interconnected to the upper tube in a one-piece configuration, and wherein the sealing element is associated with the upper tube, further comprising a fluid delivery coil positioned about the housing; and a heat exchanger associated with the fluid delivery coil.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing.

A pressure control stack, comprising: an annular drilling device with a sealing element; a first flexible coupling interconnected to the annular drilling device; and a spool interconnected to the flexible coupling, the spool having an outlet operatively interconnected to a flow line by way of a second flexible coupling, wherein the annular drilling device, includes: a housing having a first end and a second end, the housing having an opening therethrough; wherein the sealing element is maintained within the housing, the sealing element being compliant and having an opening therethrough that is adapted to selectively engage a cylindrical member; and wherein the sealing element remains static relative to the housing, wherein the housing includes a wall with a helical coil; and a heat exchanger associated with the helical coil.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member is passive and is fixed relative to the locking body, and wherein the pressure control device does not include rotating bearings.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the second profile is cylindrical.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises:

a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the second profile is cylindrical, wherein the second profile has a diameter that is less than the outer diameter of the drill string.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the internal wall includes a plurality of inwardly-extending protrusions.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the internal wall includes a plurality of inwardly-extending protrusions, wherein the plurality of inwardly-extending profiles are comprised of at least one of sinusoidal ridges, spaced rings, and dimples.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the internal wall includes a plurality of features formed in the internal wall.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the internal wall includes a plurality of features formed in the internal wall, wherein the plurality of features are comprised of at least one of grooves and dimples.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the sealing element is a compliant member made of urethane.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the sealing element is a compliant member made of urethane, wherein the urethane is impregnated with at least one of oil, silicone, or graphite.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the sealing element is a compliant member made of urethane, wherein the urethane is coated with a friction-reducing material.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the sealing element comprises an inner portion for engagement with the drill string, wherein the inner portion rotates with the drill string and the outer portion remains fixed relative to the housing.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the sealing member comprises: a first portion interconnected to the block body; a second portion having a frusto-conical profile interconnected to the first portion; an opening extending through the first portion and the second portion, the opening adapted to receive a drill string; and wherein the opening defines an internal wall having a first profile and a second profile, wherein the sealing element comprises an inner portion for engagement with the drill string, wherein the inner portion rotates with the drill string and the outer portion remains fixed relative to the housing, wherein the inner portion has a plurality of circumferential protrusions that operatively engage corresponding grooves in the outer portion.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, further comprising a fluid delivery coil positioned about the housing; and a heat exchanger associated with the fluid delivery coil.

A pressure control device, comprising: a housing; a flange selectively interconnected to the housing, the flange having a shoulder; an upper ring abutting the shoulder; a spacer abutting the upper ring; a lower ring abutting the spacer; a retaining member abutting the lower ring; a locking body positioned within the housing and interconnected to the retaining member, the locking body having a locking groove; a control ring selectively interconnected to the locking body, the control ring including an arm extending from a lower surface of the control ring, the arm having an actuator pin; a block body positioned within the locking body, the block body interconnected to a sealing member; and the block body accommodating a locking block; and wherein the locking block has a channel that operatively receives the actuator pin, and wherein when the control ring is in a first position of use, the locking block is positioned within the locking groove, and when the control ring is in a second position of use, the locking block is removed from the locking groove, wherein the housing includes a wall with a helical coil; and a heat exchanger associated with the helical coil.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the housing includes an aperture for receiving a pressurized medium to compress the compliant member about the pipe.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member comprises an internal wall with a plurality of inwardly-extending protrusions.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member comprises an internal wall with a plurality of inwardly-extending protrusions, wherein the plurality of inwardly-extending profiles are comprised of at least one of sinusoidal ridges, spaced rings, and dimples.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member includes a plurality of features formed in the internal wall.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member includes a plurality of features formed in the internal wall, wherein the plurality of features are comprised of at least one of grooves and dimples.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member made of at least one of urethane.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member made of at least one of urethane, wherein the urethane is impregnated with at least one of oil, silicone, or graphite.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the compliant member made of at least one of urethane, wherein the urethane is coated with a friction-reducing material.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, further comprising a fluid delivery coil positioned about the housing; and a heat exchanger associated with the fluid delivery coil.

A pressure control device, comprising: a housing; an upper ring interconnected to the housing; a compliant member interconnected to the upper ring; a lower ring interconnected to the compliant member, and slidingly associated with an inner surface of the housing; and wherein the compliant member is adapted to elongate to accept a pipe, wherein the housing includes a wall with a helical coil; and a heat exchanger associated with the helical coil.

Those of skill the in art will appreciate that the invention described above may be combined in various configurations without departing from the scope of the invention. For example, the sealing element may be combined with a quick release, the sealing element may be combined with a cooled housing, an integrated sealing element/housing may be combined with a cooled housing that may or may not incorporate a quick release mechanism or breach lock. Also, these and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described below.

Further, the Summary of the Invention is neither intended nor should it be construed as representing the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and with the general description of the invention given above and the detailed description of the drawings given below, explain the principles of these inventions.

Figure 1:
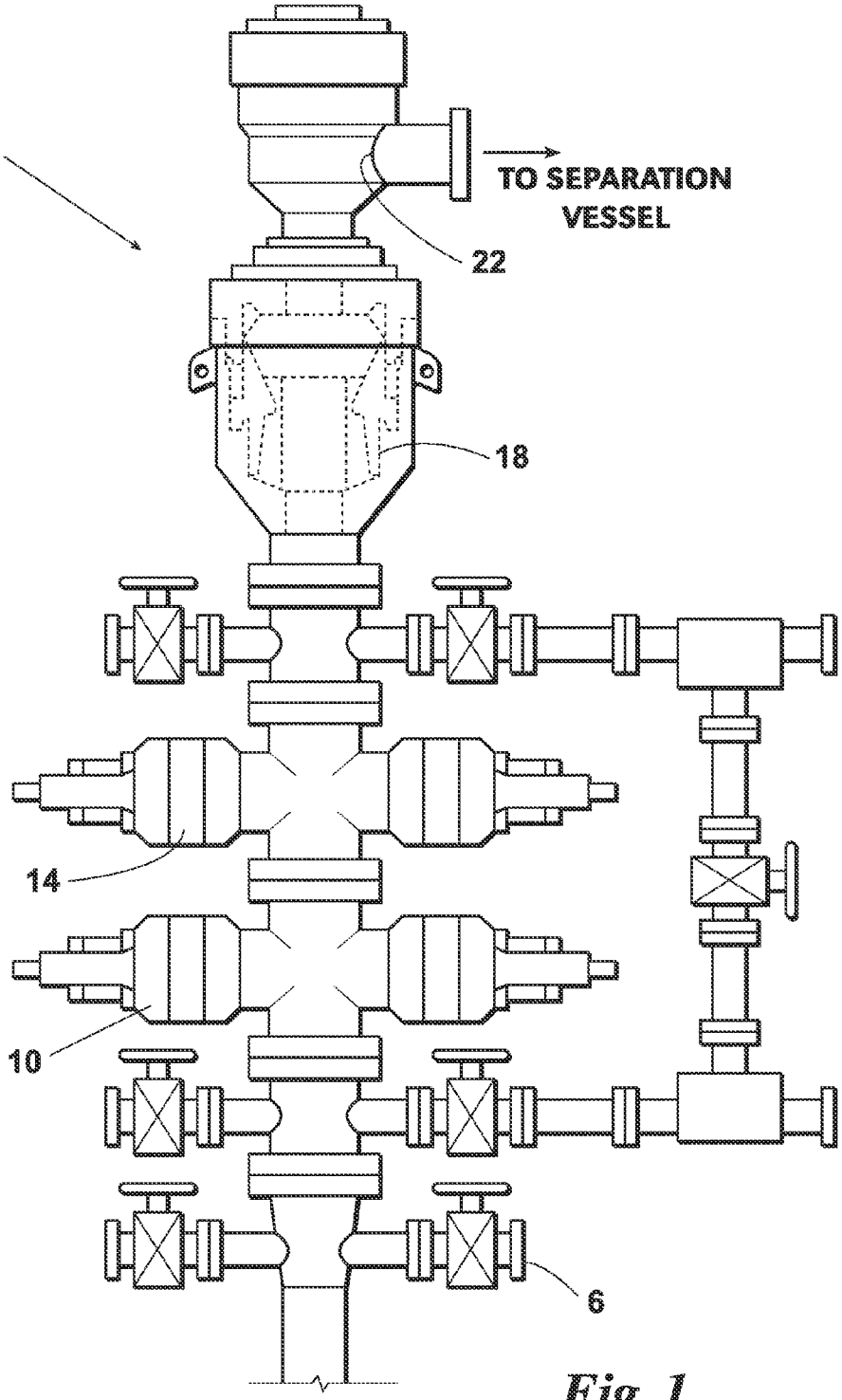
Fig. 1 ( PRIOR ART )
FIG. 1 is a schematic of a pressure control stack of the prior art.
Figure 2:
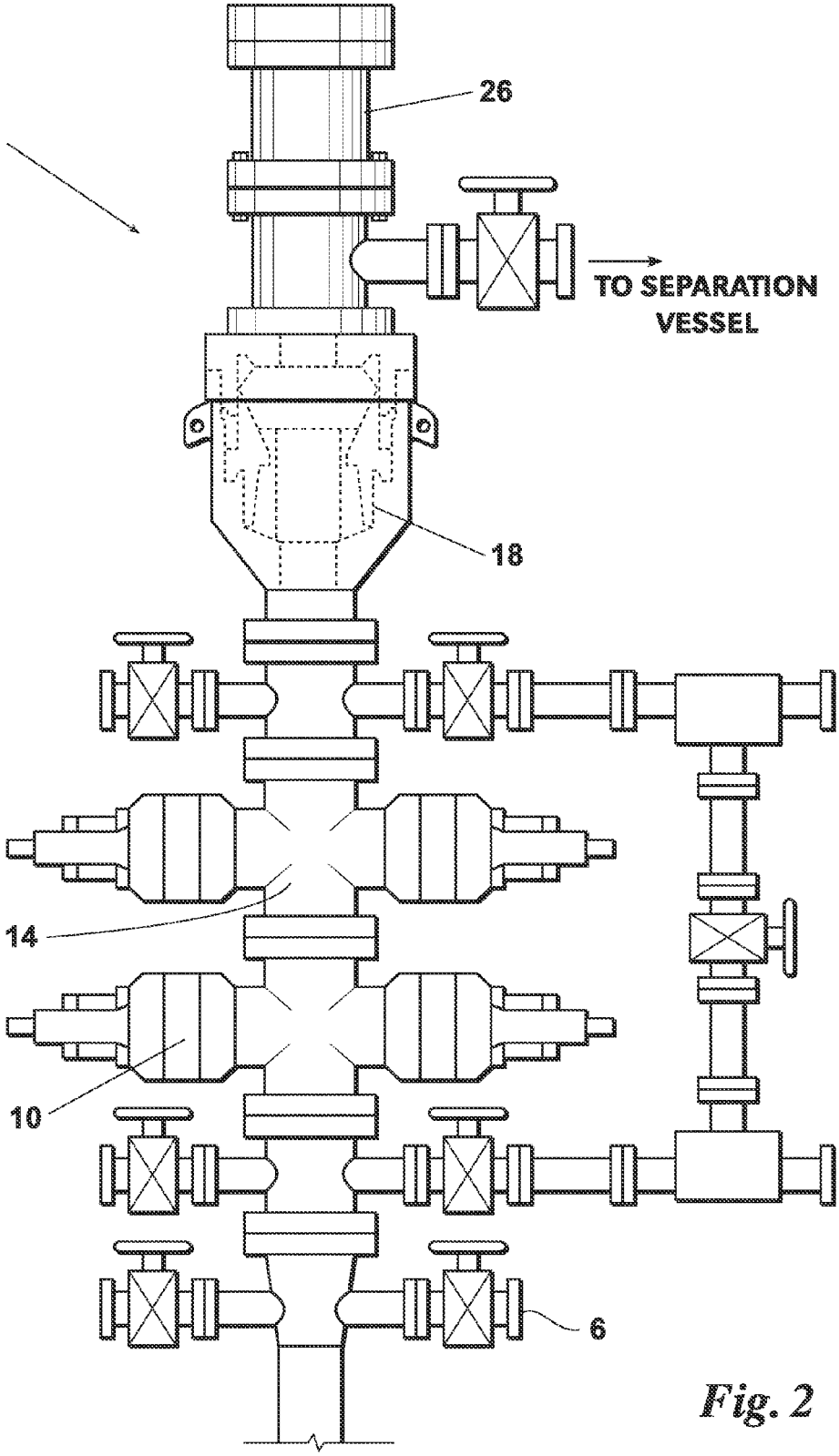
FIG. 2 is a schematic of a pressure control stack of one embodiment of the present invention.
Figure 4:
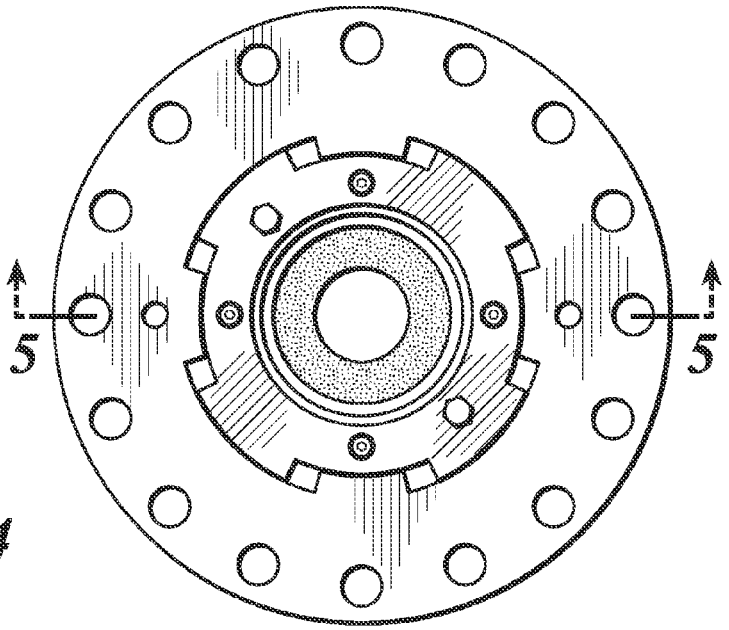
FIG. 4 is a top plan view of FIG. 3.
Figure 3:
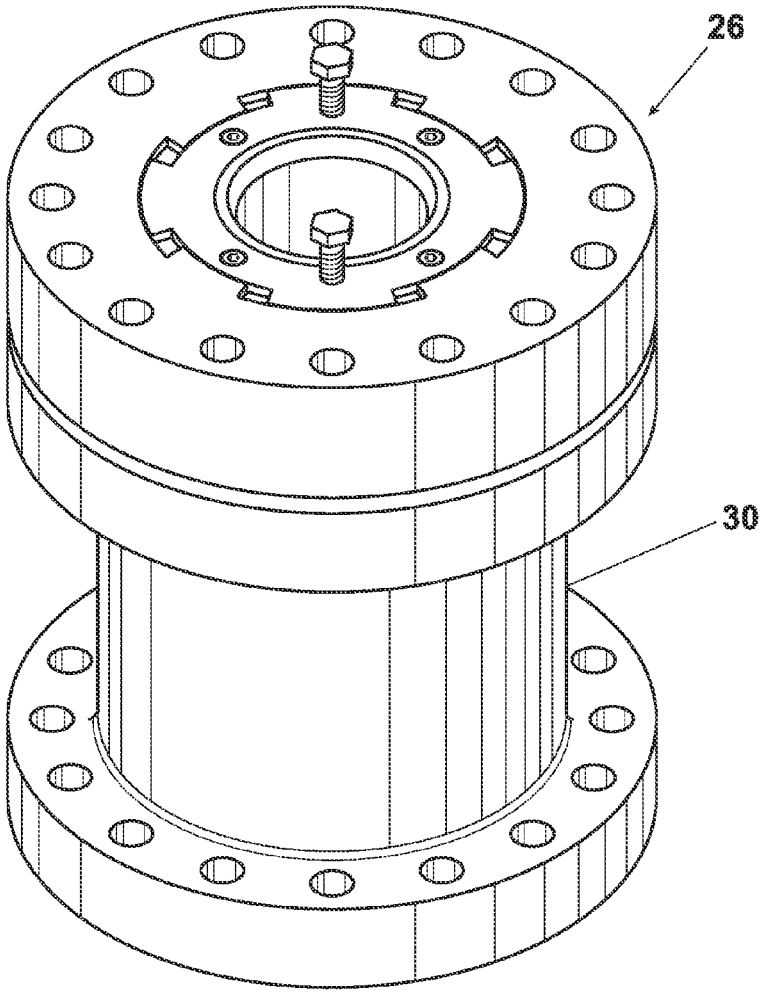
FIG. 3 is a perspective view of an annular drilling device of one embodiment of the present invention.
Figure 5:
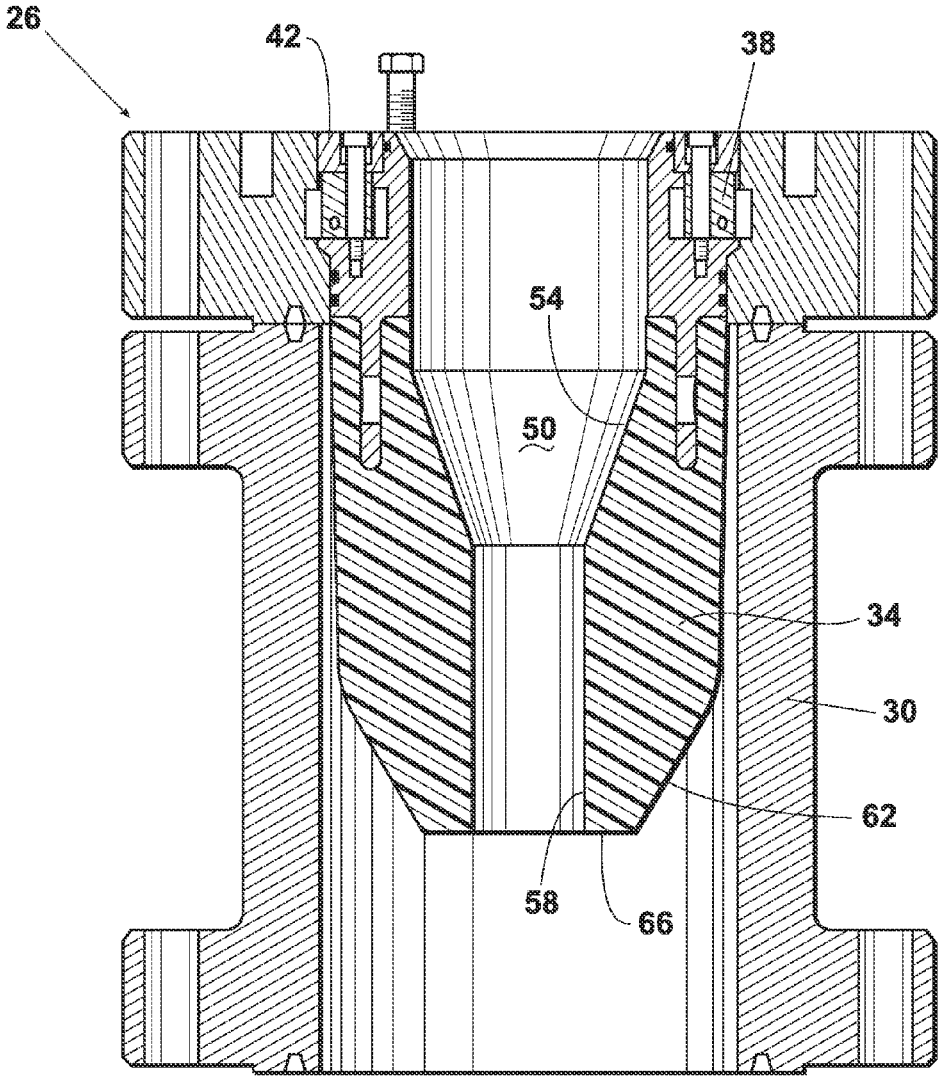
FIG. 5 is a cross-sectional view of FIG. 4.

To assist in the understanding of one embodiment of the present invention the following list of components and associated numbering found in the drawings is provided herein:

| # | Component |
|---|---|
| 2 | Pressure control stack |
| 6 | Nitrogen injection port |
| 10 | Blind ram |
| 14 | Pipe ram |
| 18 | Annular BOP |
| 22 | Rotating pressure control head |
| 26 | Passive annular drilling device |
| 30 | Housing |
| 34 | Sealing element |
| 38 | Locking block |
| 42 | Control ring |
| 46 | Drill pipe |
| 50 | Inner surface |
| 54 | Conical profile |
| 58 | Cylindrical profile |
| 62 | Conical surface |
| 66 | Distal end |
| 68 | Compliant member |
| 70 | Cylindrical portion |
| 74 | Block body |
| 78 | Ridges |
| 82 | Grooves |
| 86 | Dimples |
| 90 | Sealing element |
| 94 | Inner portion |
| 98 | Outer portion |
| 102 | Protrusion |
| 106 | Groove |
| 120 | Coil |
| 124 | Heat exchanger |
| 128 | Channel |
| 132 | Locking body |
| 136 | Flange |
| 137 | Shoulder |
| 138 | Retaining member |
| 139 | Upper ring |
| 140 | Lower Ring |
| 144 | Spacer |
| 148 | Locking blocks |
| 150 | Locking groove |
| 152 | Locking grooves |
| 156 | Control ring |
| 160 | Fasteners |
| 164 | Arms |
| 168 | Actuator pins |
| 172 | Channels |
| 202 | Active sealing element |
| 206 | Cavity |
| 210 | Ring |
| 214 | Seal groove |
| 218 | Outer surface |
| 222 | Conical portion |
| 226 | Charging port |
| 230 | Wall |
| 234 | Hole |
| 302 | Semi-active sealing element |
| 306 | Cavity |
| 402 | Sealing element |
| 406 | Upper ring |
| 410 | Lower ring |
| 414 | Seal groove |
| 418 | Compliant member |
| 422 | Annulus |
| 426 | Housing |
| 430 | Tool joint |
| 502 | Sealing element |
| 506 | Housing |
| 510 | Inner surface |
| 514 | Ribs |
| 518 | Flange |
| 522 | Threads |
| 526 | Spool |
| 530 | Outlet |
| 534 | Threads |
| 540 | Port |
| 544 | Flange |
| 574 | Block Body |
| 580 | Housing |
| 602 | Annular drilling device |

-continued

| # | Component |
|---|---|
| 604 | Threads |
| 608 | Sealing portion |
| 702 | Annular drilling device |
| 706 | Flexible coupling |
| 710 | Sealing element |
| 714 | Block body |
| 718 | Locking body |
| 722 | Annular drilling device upper flange |
| 726 | Flange |
| 730 | Annular drilling device lower flange |
| 734 | Flexible coupling upper flange |
| 738 | Flexible coupling lower flange |
| 742 | Spool |
| 746 | Outlet |
| 750 | Outlet flange |
| 754 | Flowline flange |
| 758 | Flowline |
| 762 | Drill pipe |
| 766 | Upper tube |
| 770 | Lower tube |
| 774 | Flared end |
| 778 | Transition ring |
| 782 | Spherical bearing |
| 786 | Annular interface member |
| 790 | Outer body |
| 794 | Upper flange |
| 798 | Lower flange |
| 800 | Spherical joint |
| 804 | Flexible bellows |
| 805 | Flexible conduit |
| 808 | Rubber joint |
| 902 | Flexible coupling |
| 906 | Sealing element |
| 910 | Housing |
| 914 | Housing threads |
| 918 | Flexible coupling threads |
| 922 | Thread |
| 926 | Spool threads |
| 930 | Spool |
| 934 | Annular drilling device |
| 938 | Tube |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1 shows a pressure control stack 2 of the prior art. More specifically, a plurality of components is commonly used to address static or transitory pressure fluctuations within a wellbore. The first line of defense is a nitrogen injection port 6, which receives nitrogen to pressurize to wellbore to counteract a downhole pressure increase. A blind ram 10 is included that seals the wellbore when a drill pipe is not inserted into the wellbore. When the drill pipe is in place, a pipe ram 14 is used to close around the drill pipe. In some instances, at least one sheer ram (not shown) is included that cuts through the drill pipe or casing with hardened steel sheers to close off the wellbore. Next an annular blowout preventer ("BOP") 18 is included that can close around the drill pipe, casing, or any other non-cylindrical object. Annular blowout preventers are typically located at the top of the control stack 2 above the series of rams. Finally, prior art systems employ a rotating pressure control head 22.

Figure 6:
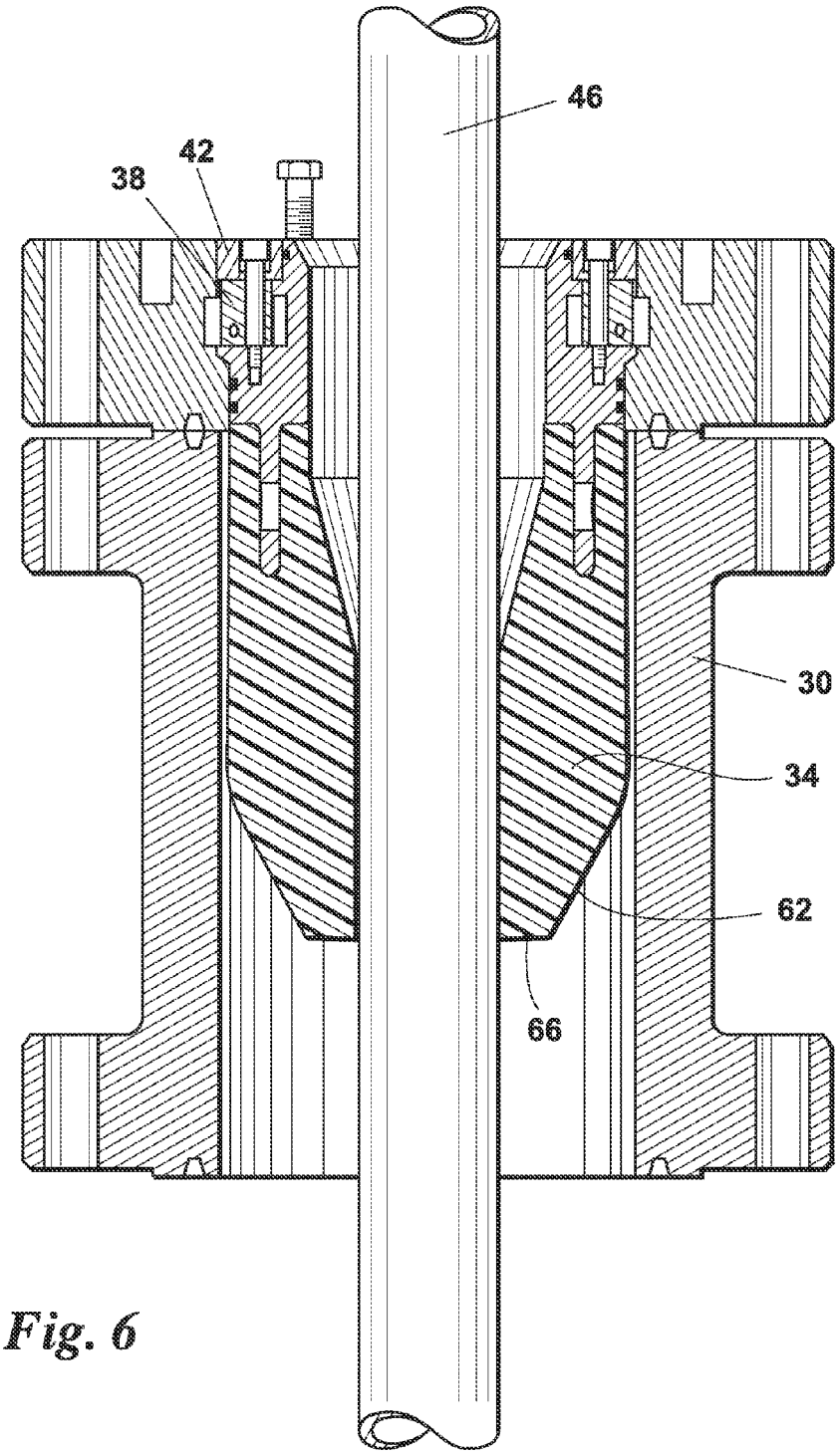
FIG. 6 is a cross-sectional view of FIG. 4, wherein a drill pipe is shown inserted into the annular drilling device.

FIGS. 2-6 show a annular drilling device 26 of one embodiment of the present invention and the same employed on a pressure control stack 2. The annular drilling device 26 is positioned above the annular BOP 18 instead of a rotating annular drilling device of the prior art. The annular drilling device 26 comprises a housing 30 that supports a passive sealing element 34. The sealing element 34 is maintained by locking blocks 38 and a control ring 42, which will be described in further detail below. The sealing element 34 receives a drill pipe 46 as shown in FIG. 6 and firmly engages against the outer diameter of the same. The sealing element 34 is stationary and does not rotate relative to the housing 30. Thus, a plurality of bearings and rotating seals, which are found in the prior art annular drilling devices are not required.

The inner surface 50 of the sealing element 34 has a diameter less than the outer diameter of the drill pipe 46, which creates a tight seal between the two components while the drill pipe 46 is rotating. A portion of the sealing element's inner surface 50 may have a conical or frusto-conical profile 54 that helps initially guide the drill pipe to a portion of the inner surface 50 having a generally cylindrical profile 58 that engages the drill pipe. Furthermore, the sealing element 34 may have a conical, frusto-conical, or otherwise angled surface 62 at its distal end 66 that is contacted by drilling fluid. Pressure drilling fluid urges the sealing element inwardly to increase the sealing element's grip on the drill pipe 46.

Figure 7:
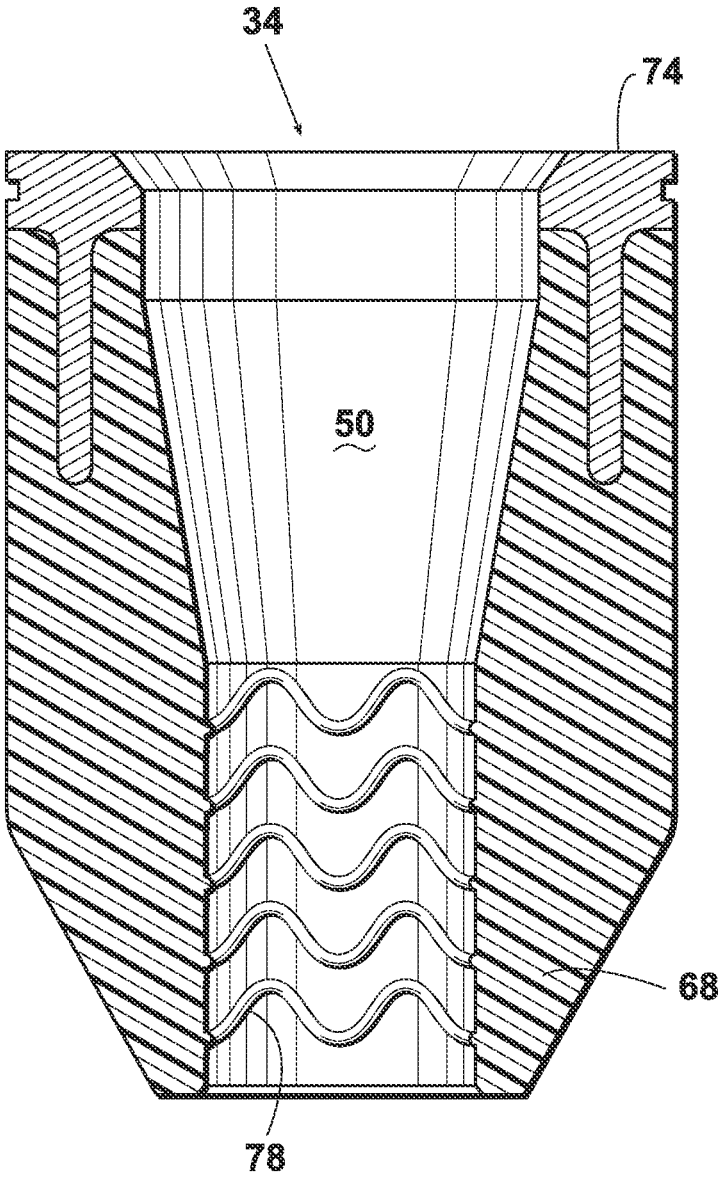
FIG. 7 is a cross-sectional view of a sealing element of another embodiment of the present invention.
Figure 9:
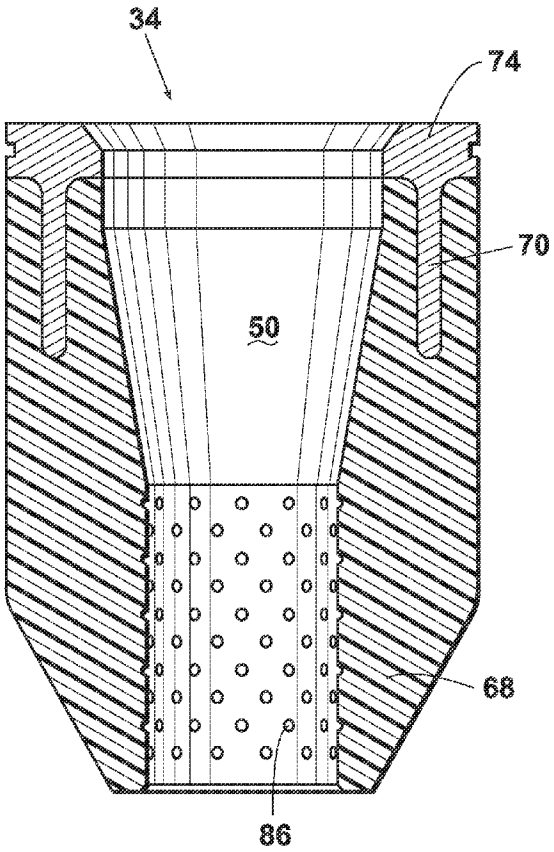
FIG. 9 is a cross-sectional view of a sealing element of another embodiment of the present invention.
Figure 8:
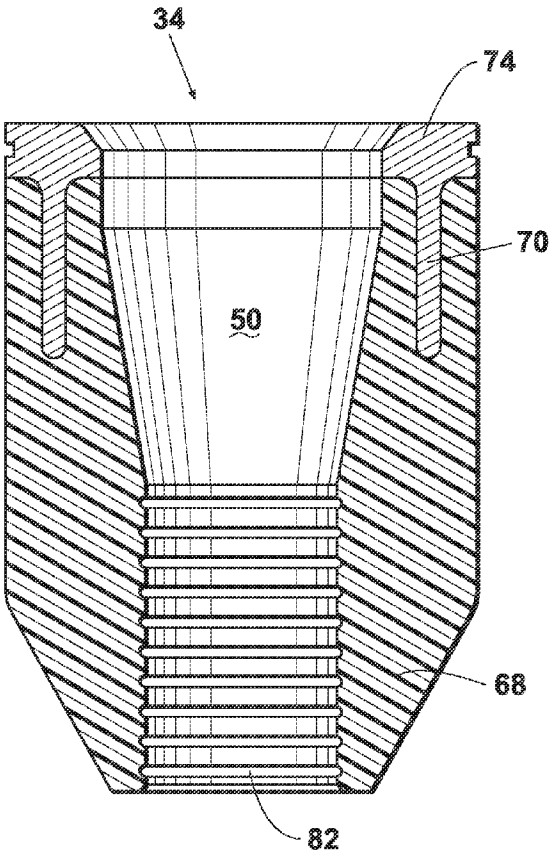
FIG. 8 is a cross-sectional view of a sealing element of another embodiment of the present invention.

FIGS. 7-9 show sealing elements 34 of other embodiments of the present invention that are comprised of a compliant or semi-compliant member 68. Here, a urethane member 68 that is molded or interconnected to a cylindrical portion 70 extending from a block body 74. Alternatively, the sealing element 34 may be molded onto a flange interconnected directly to the housing. As the rotation of the drill pipe within the sealing element will generate friction, some embodiments of the present invention include inner surfaces 50 with a non-continuous profile. For example, the inner surface 50 of the sealing element 34 may include a plurality of protrusions, ridges 78 (for example, FIG. 7), grooves 82 (for example, FIG. 8), or dimples 86 (for example, FIG. 9) which may be horizontal, wavy, angled, etc. The plurality of grooves or ridges allows for added lubrication, or drilling fluid, to be maintained between the sealing element 34 and the drill pipe. Thus, although portions of the sealing element are in contact with the rotating drill pipe, portions of the inner surface 50 are spaced therefrom and help maintain the lubricating interface that reduces friction and heat.

Figure 11:
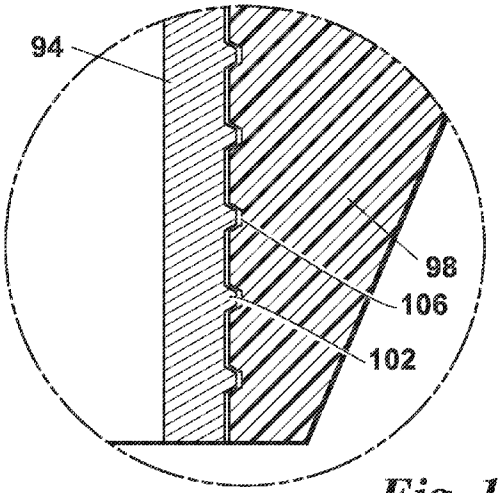
FIG. 11 is a detailed view of FIG. 10.
Figure 12:
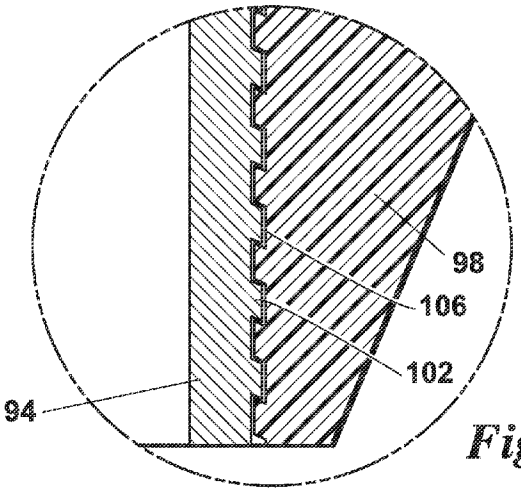
FIG. 12 is a detailed view of an alternate embodiment of FIG. 10.
Figure 10:
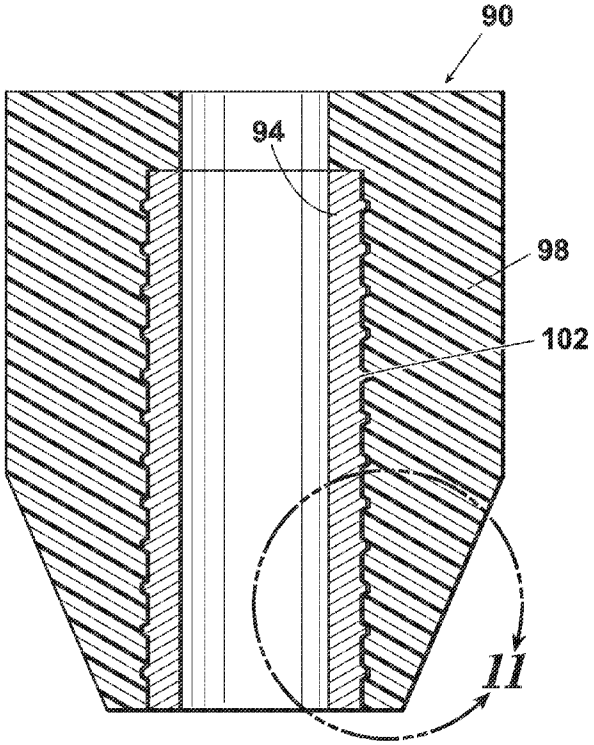
FIG. 10 is a cross-sectional view of a sealing element of another embodiment of the present invention comprising a stationary outer portion and a rotating inner portion.

FIGS. 10-12 show a two-piece stationary sealing element 90 used by some embodiments of the present invention. The sealing element 90 comprises inner portion 94 and an outer portion 98. The outer portion 90 is stationary as in the embodiments described above and may be integrated into a housing (see, for example, FIG. 29). However, the inner portion 94 that firmly engages the drill pipe and rotates therewith. The outer portion 98 maintains the position of the inner portion 94 as it rotates. Inner portion 94 may have a plurality of outwardly-extending protrusions 102, for example rings, that fit within corresponding grooves 106 of the outer portion 98. As an embodiments described above, the outer portion 98 may be made of urethane, having a shore hardness of about 90. The inner portion may be made of urethane having a shore hardness less than, equal to, or greater than that of the outer portion 98. The shape of the outwardly-extending protrusions allow for the inner portion 94 to be incrementally inserted into the outer portion 98.

FIGS. 11 and 12 show the interaction between inner portion 94 and the outer portion 98. The outwardly-extending protrusions 102 may be in the form of or mimic chevron seals (FIG. 12) that prevent fluid from escaping the housing. In addition, the space between two adjacent outwardly-extending portions act as journal bearings that use lubrication or drilling fluid to reduce friction between the inner portion 94 in the outer portion 98. For example, flocculent previously added to the wellbore may be a lubricant. The sealing element 90 using the contemplated journal bearings and chevron seals act to maintain wellbore pressure while allowing some leakage. If, however, leakage rises above a predetermined threshold, as inspected visually or with sensing means, technicians will know that the sealing element 90 needs to be serviced or replaced.

Figure 13:
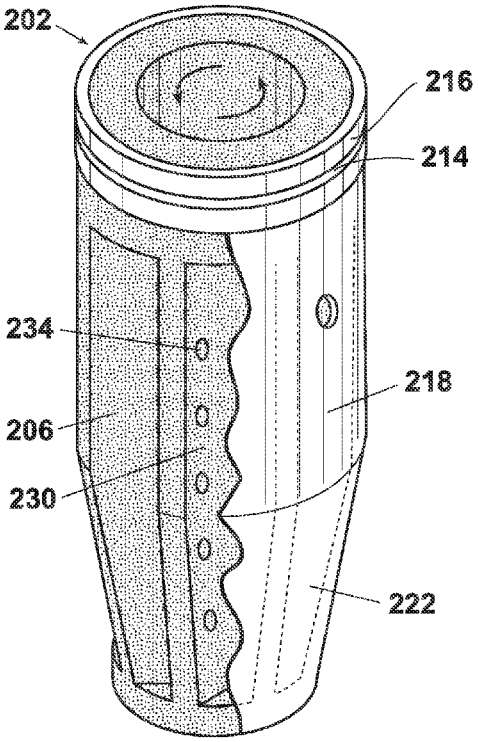
FIG. 13 is a perspective view of a stationary active sealing element employed by some embodiments of the present invention.

FIG. 13 shows a stationary active sealing element 202 employed by some embodiments of the present invention that is similar to that described in FIGS. 11, 12, and 15B of the '590 patent. The sealing element 202 has a plurality of cavities 206 that receive hydraulic pressure which expand to deflect, and deform portions of the sealing element 202 into tight engagement with the drill pipe. The sealing element 202 is supported by a metal ring 216 having a seal groove 214. The outer surface 218 of the sealing element 202 includes an angled or conical portion that is acted on by drilling mud which further deflects the sealing element into a tight engagement with the drill pipe. A charging port 226 is provided that allows hydraulic pressure to be applied into one or more cavities 206 of the sealing element. Other embodiments provide charging ports to each cavity 206. If one charging port 226 is used, walls 230 between cavities 206 may include one or more holes 234 to allow hydraulic pressure transfer. In operation, hydraulic pressure will collapse the sealing element walls 230 around the drill pipe similar to that of an iris diaphragm. This, in combination with the externally applied mud pressure creates a tight seal about the drill pipe.

When the drill pipe is removed from the sealing element 202, the pressurized hydraulic fluid can be introduced into the cavities 206 to cause the inner walls 230 of sealing element 202 to constrict onto itself, closing off the wellbore. Introducing pressurized drilling fluid or hydraulic fluid into cavities 206 causes sealing element 202 to expand inwardly to form a pressure retaining seal on the drill pipe. The shape of cavities 206 is such that cavities 206 constrict the drill pipe in a controlled and predictable manner. Unlike prior art sealing elements that fold, twist, wrinkle, and bend in unpredictable manners as they are forced onto the rotating drill pipe, the inner wall of sealing element 202 twists as sealing element 202 expands inwardly. The twisting action of sealing element 202 results in a pressure seal between the drill pipe and sealing element 108 that is sufficient for almost any drilling application.

In this application, sealing element 202 can perform the same function as an annular BOP or blind ram and can withhold wellbore pressures of up to 1,500 psi. The active nature of the sealing element 202 allows for the inner diameter to be greater than the outer diameter of the drill pipe, which helps reduce wear on the sealing element 202 as the drill pipe and associated tool joints are stabbed therethrough.

Figure 15:
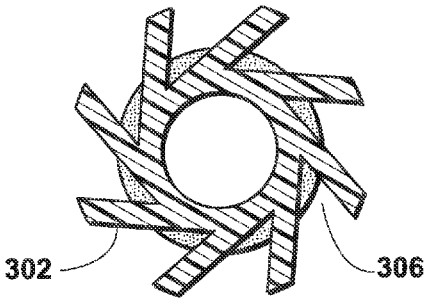
FIG. 15 is a cross section of FIG. 14.
Figure 16:
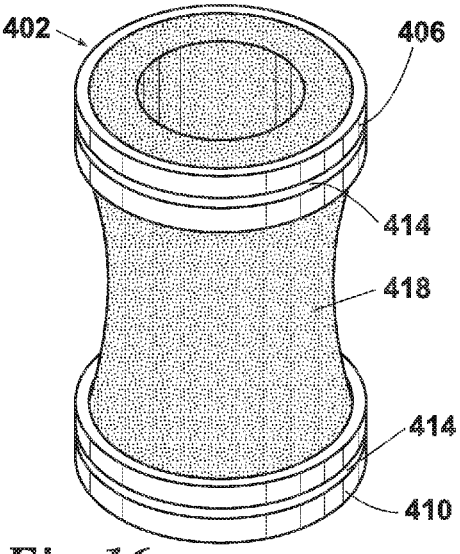
FIG. 16 is a perspective view of a stationary active sealing element employed by some embodiments of the present invention.
Figure 14:
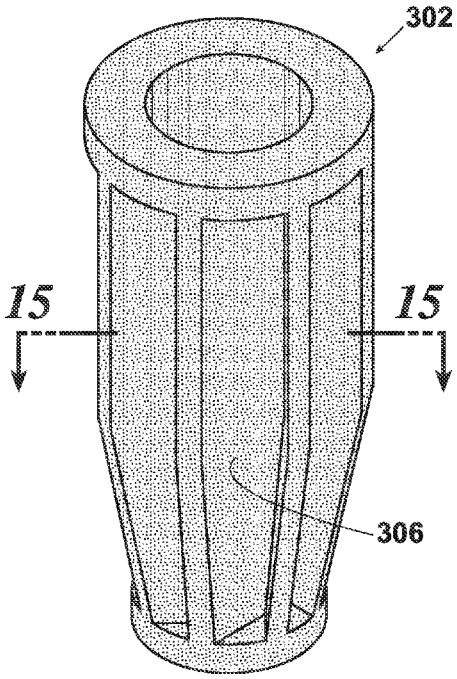
FIG. 14 is a perspective view of a stationary semi-active sealing element employed by some embodiments of the present invention.
Figure 17:
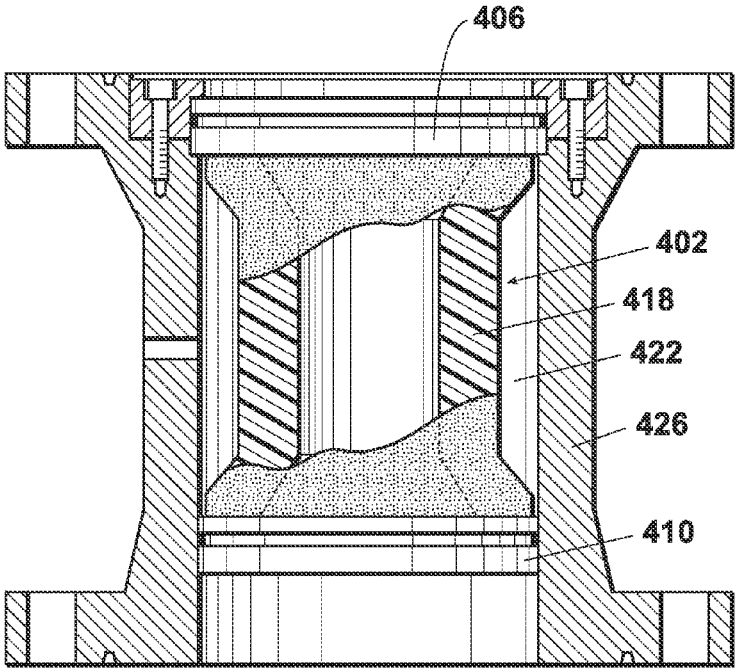
FIG. 17 is a cross-sectional view of the sealing element of FIG. 16 installed in a housing.

FIGS. 14 and 15 show a semi-active sealing element 302 of another embodiment of the present invention. The configuration of this embodiment is also similar to that described in FIG. 15B of the '590 patent. Here, however, the sealing element 302 does not rotate and remains stationary as described above. The sealing element 302 includes a plurality of cavities 306 that receive pressurized drilling fluid. Once full, the cavities 306 cause the sealing element 302 to close about the drill pipe, similar to an iris diaphragm. Introducing pressurized drilling fluid into cavities 306 causes sealing element 302 to expand inwardly to form a pressure retaining seal on the drill pipe. The shape of cavities 306 is such that cavities 306 constrict the drill pipe in a controlled and predictable manner.

FIG. 15 is a cross-sectional view of FIG. 14 that illustrates the shape of the semi-active sealing element 302. Similar to the embodiment shown in FIG. 13, the sealing element 302 is formed by pouring liquid urethane into a cylinder containing a mold, and then removing the mold after the urethane has set in the desired configuration. Persons skilled in the art will know other methods of forming sealing element 302, and that sealing element 302 may be formed from rubber, thermoplastic rubber, plastic, or any other elastomer or elastomeric material possessing the contemplated properties.

The semi-active sealing element 302 may have an inner diameter that is slightly greater than the outer diameter of the drill pipe, providing a small gap between the sealing element 302 and the drill pipe. This small gap may be closed from pressure generated by the drilling mud. Alternatively, the gap may be lessened such that the inner diameter of the sealing element 302 does not contact the outer diameter of the drill pipe and a small boundary layer of drilling fluid is formed by the spinning drill pipe, which creates a seal. Again, a gap allows the drill pipe to be inserted into the wellbore with minimal contact with sealing element, which increases sealing element life. After the drill pipe is situated within the wellbore and drilling commences, drilling fluid pressure firmly seats the sealing element onto the outer surface of the drill pipe.

Regardless the configuration of the seal—active or semi-active—the seal between sealing element and the drill pipe is sufficiently strong that the vertical height of sealing element may be less than the height required by prior art sealing elements. As an example, the prior art rotating BOPs require a sealing element as much as fifty inches in vertical height. Some sealing elements of the present invention can maintain the same pressure with only fifteen inches of vertical height. A shorter sealing element translated to a shorter annular drilling device, which reduces overall stack height.

FIGS. 16-19 show an active sealing element 402 employed by some embodiments of the present invention. Here, the sealing element 402 is comprised of an upper, stationary ring 406 and a lower ring 410, each having seal grooves 414 that are connected by a compliant member 418 made of an elastomeric or urethane. As in the other embodiments described above, the sealing element 402 remains stationary relative to the rotating drill pipe. Further, the compliant member 418 may have an hourglass shape such that a portion thereof contacts the drill pipe 46. Preferably, however, the sealing element 402 is active wherein hydraulic pressure received through the housing fills an annulus 422 between the outer surface of the compliant member and the inner surface of the housing 426. Thus, a small gap can be provided which allows the drill pipe 46 to be stabbed through the sealing element 402 more easily.

Figure 18:
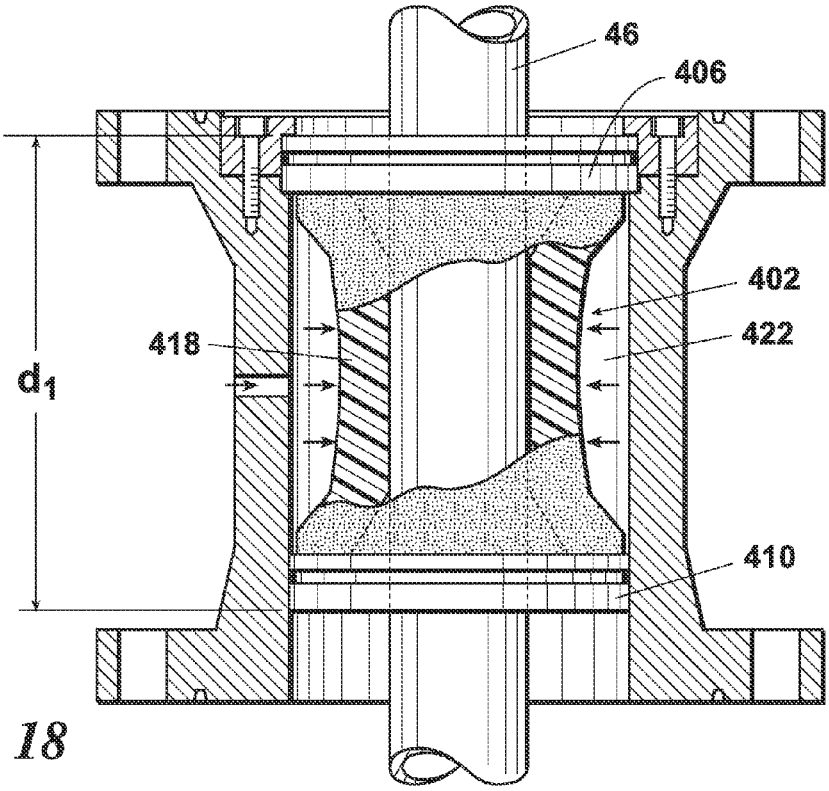
FIG. 18 is a cross-sectional view of the sealing element of FIG. 16 with a drill pipe positioned therein.

FIG. 18 shows the drill pipe 46 positioned within the sealing element 402 which has been energized such that the inner surface of the sealing element 402 contacts the drill pipe 46. As the drill pipe 46 rotates, friction may be reduced by reducing the external pressure added to the outer surface of the compliant member 418. This may create a small gap that forms a boundary layer of drilling mud that forms a seal. Other embodiments, however, maintain a tight connection between the drill pipe 46 and the compliant member 418. The compliant member 418 may be internally lubricated as described above or lubrication can be added that helps reduce the friction between the rotating drill pipe 46 and the sealing element 402.

Figure 19:
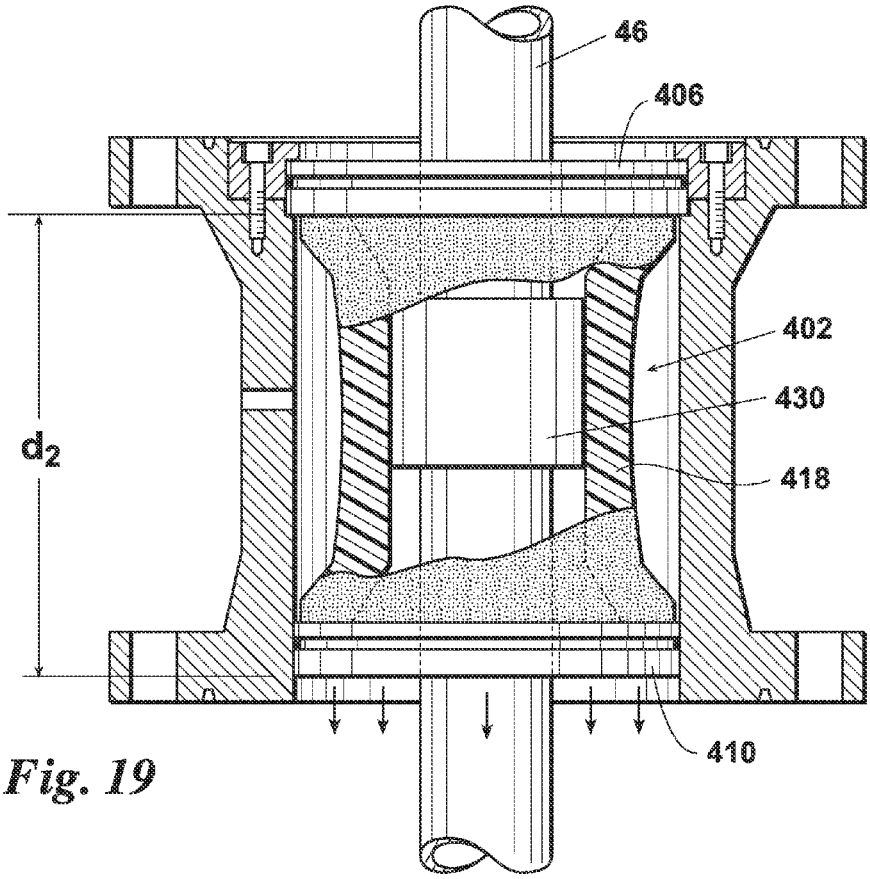
FIG. 19 is a cross-sectional view similar to that of FIG. 18 showing a tool join positioned within the sealing element.

Referring now to FIGS. 18 and 19, when installed in the housing, the lower ring 410 floats and the upper ring is fixed. In normal use, the distance between the upper surface of the upper ring 406 and the lower surface of the lower ring 410 ($d_1$) is generally constant. When a large item, such as a tool joint 430, is passed through the compliant member 418, the lower ring 410 moves away from the upper ring 406 which increases the distance between these components ($d_2$). This ability to accommodate tool joints, etc., allows increases life of the compliant member 418. Like the embodiments of the present invention described above, this sealing element 402 may be made to completely seal off the wellbore like an annular BOP.

Figure 20:
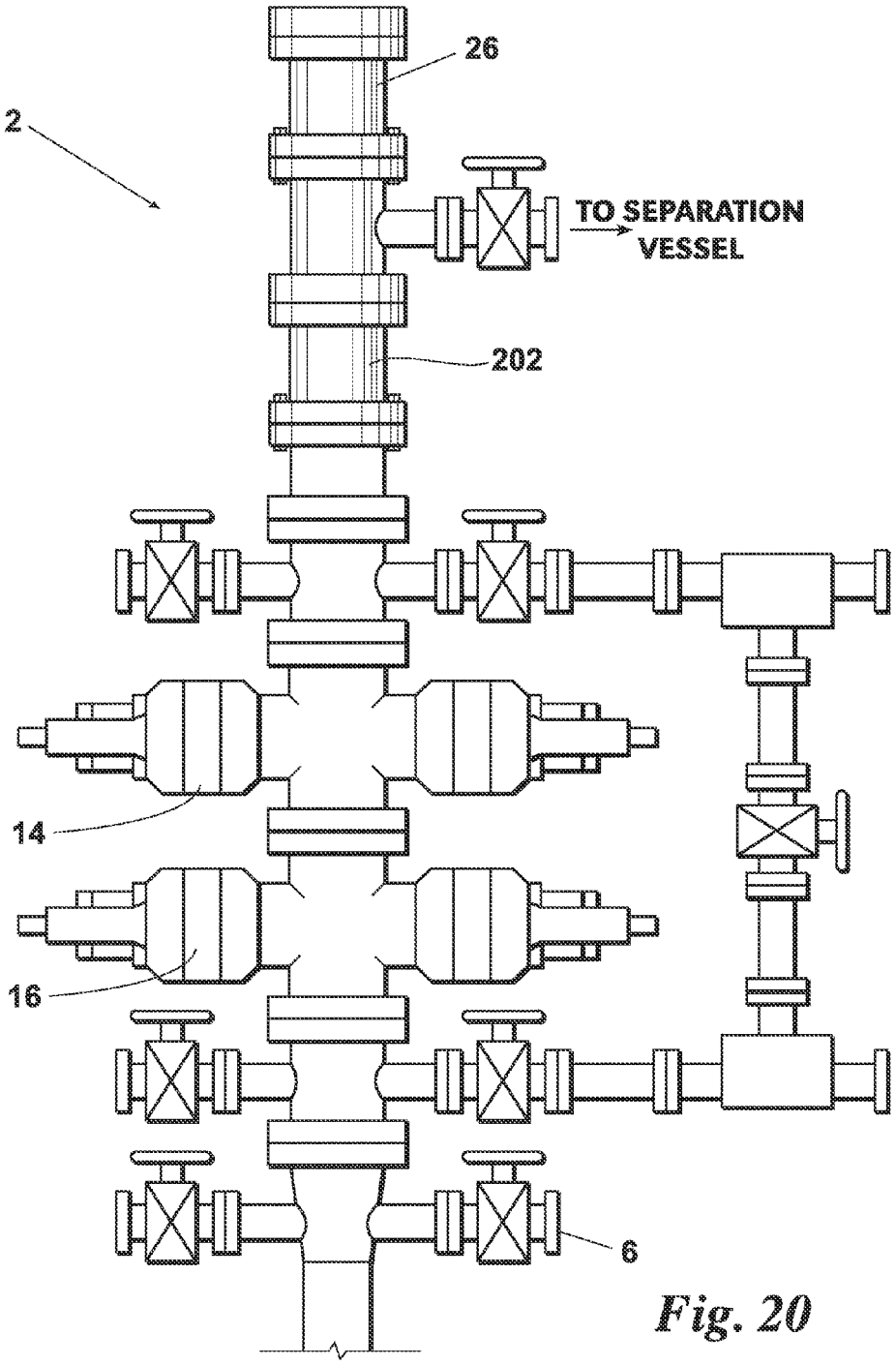
FIG. 20 is a schematic of a drill string employing embodiments the present invention, wherein an annular BOP is not required.

To capitalize on the ability of some embodiments of the present invention to completely seal off the wellbore, some embodiments of the present invention allow the pressure control stack 2 to be used without an annular BOP as shown in FIG. 20. More specifically, FIG. 20 shows a system wherein the passive annular drilling device 26 and active annular drilling device 202 are employed. The passive annular drilling device 26 replaces the rotating annular drilling device of the prior art. The active annular drilling device 202 replaces the annular BOP. The active annular drilling device 202 may only be employed, wherein the active annular drilling device 202 performs tasks previously performed by the rotating pressure control head and the annular BOP. As one of skill the art will appreciate, this configuration vastly simplifies the pressure control stack thus reducing system cost and complexity.

Figure 21:
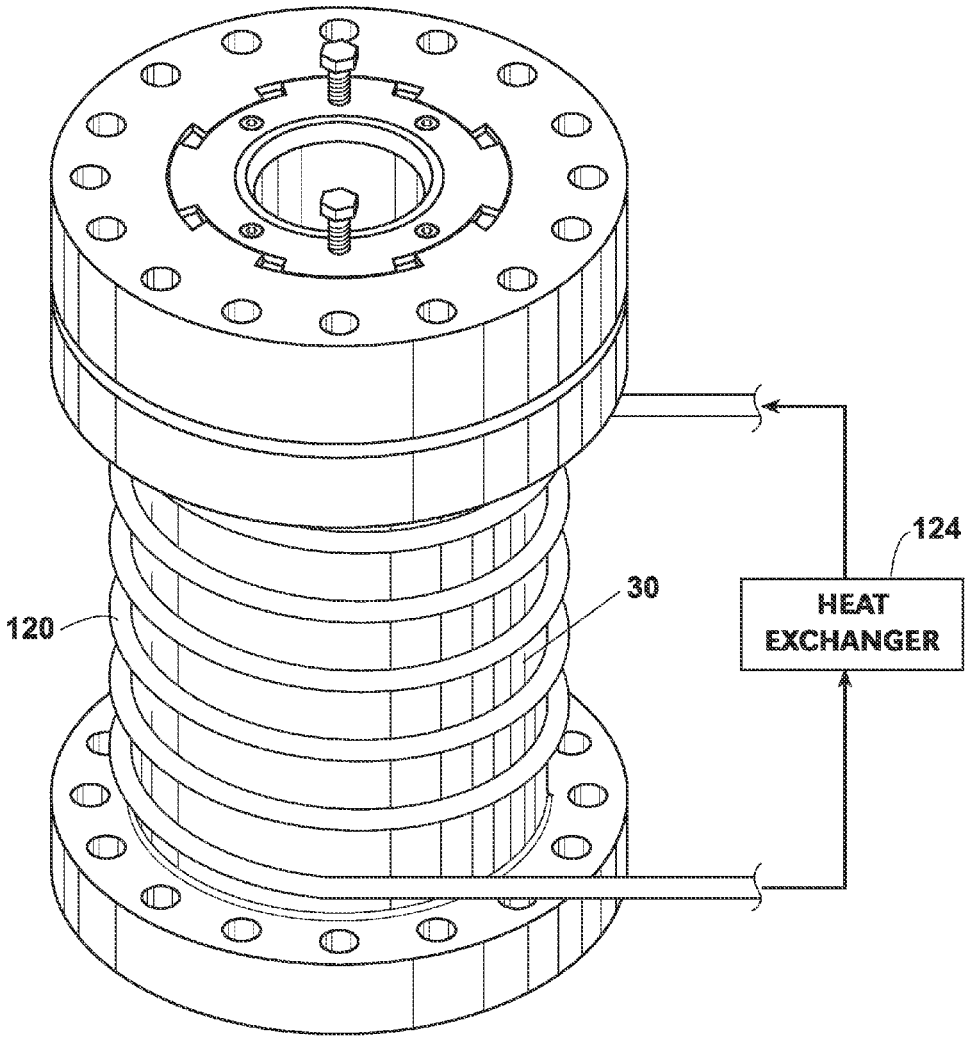
FIG. 21 is a housing of one embodiment of the present invention that includes an external cooling coil.
Figure 23:
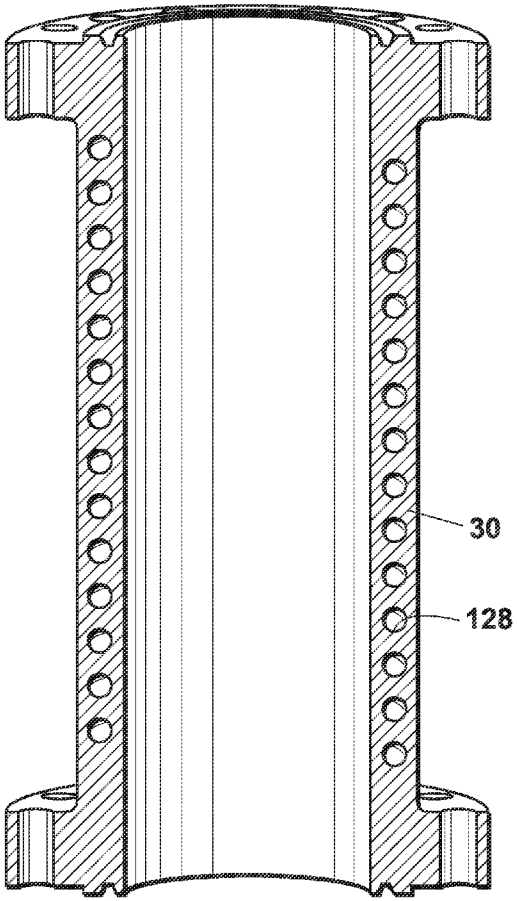
FIG. 23 is a housing of one embodiment of the present invention that employs a plurality of cooling channels.
Figure 22:
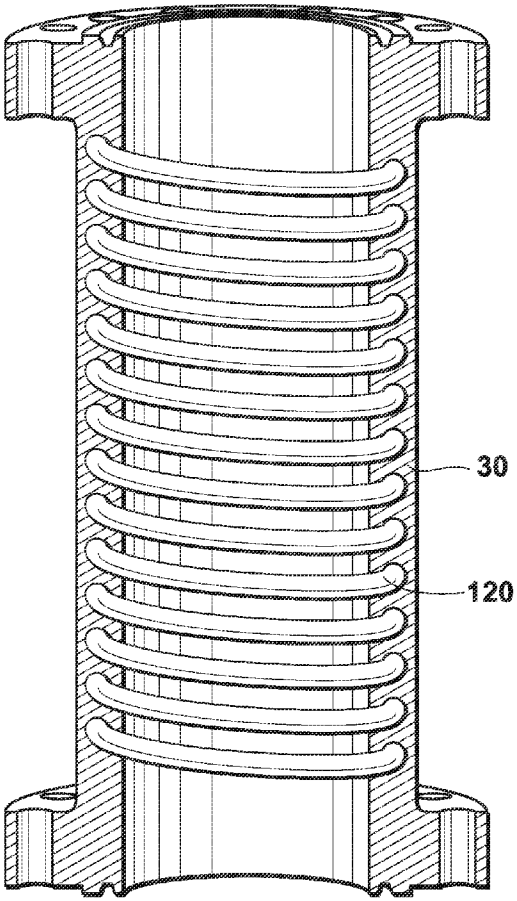
FIG. 22 is a housing of one embodiment of the present invention that employs an internal cooling coil.

FIGS. 21-23 show housings 30 employed by some embodiments the present invention. More specifically, as appreciated by those a skill the art, the rotating drill pipe will create heat, regardless if the frictional interactions between the rotating drill pipe and the sealing element are reduced. Heat generated by the friction-producing interactions will degrade the sealing element and will adversely affect any lubrication present between the sealing element and the rotating drill pipe. Thus, embodiments of the present invention employ cooling devices.

FIG. 21 shows a housing 30 wrapped in a cooling coil 120. The coil receives water that receives heat from the housing 30. The resultant steam is vented and the fluid is replaced by cold water. Alternatively, the coil carries refrigerant used in a common refrigeration cycle wherein heat energy taken from the housing is transferred to a heat exchanger 124 to generate mechanical energy, heat a dwelling, etc.

FIGS. 22 and 23 show alternative embodiments wherein the coil 120 is integrated into the thickness of the housing 30, or the housing 30 is formed with a plurality of cooling channels 128.

Those of skill in the art will appreciate that the sealing elements described herein may be formed with micro-channels that receive cooling fluid. Further, the sealing element may include at least one radially-extending channel that feeds lubrication.

FIGS. 24-28 show a quick disconnect system employed by some embodiments of the present invention. More specifically, as the sealing element 34 must be replaced, sometimes frequently, it is advantageous provide a quick and easy way to remove the sealing element from the housing. Prior art systems commonly require a complicated method of removing various fasteners and components to gain access to the sealing element which is time-consuming and costly. Accordingly, some embodiments of the present invention employ a system wherein the sealing element 34 is associated with a block body 74. The block body 74 may include an outwardly-extending member or members that interface with a sealing element 34. For example, block body 74 may have a cylindrical portion 70 that the sealing element is molded onto. The block body 74 is inserted into the housing 30 inward of a locking body 132 that is positioned within the housing 30. The contemplated quick disconnect system is used by a pressure control device, of one embodiment that includes the housing 30. The housing accepts a flange 136 with a shoulder 137. The flange 136 is spaced from a retaining member 138 by way of an upper ring 139, a lower ring 140, and a spacer 144 positioned between the upper ring 139 and the lower ring 140. The retaining member 138 maintains the position of the locking body 132. The housing 30 also includes a flange 136 and an associated cylindrical portion that maintains the position of the locking body 132 by way of rings 140 and spacers 144. The block body 74 is held in place by interaction of a plurality of locking blocks 148 that slidingly move outwardly into a locking groove 150 in the locking body 132. A control ring 156 is situated above the block body 74 and controls the location of the locking blocks 148.

Figure 27:
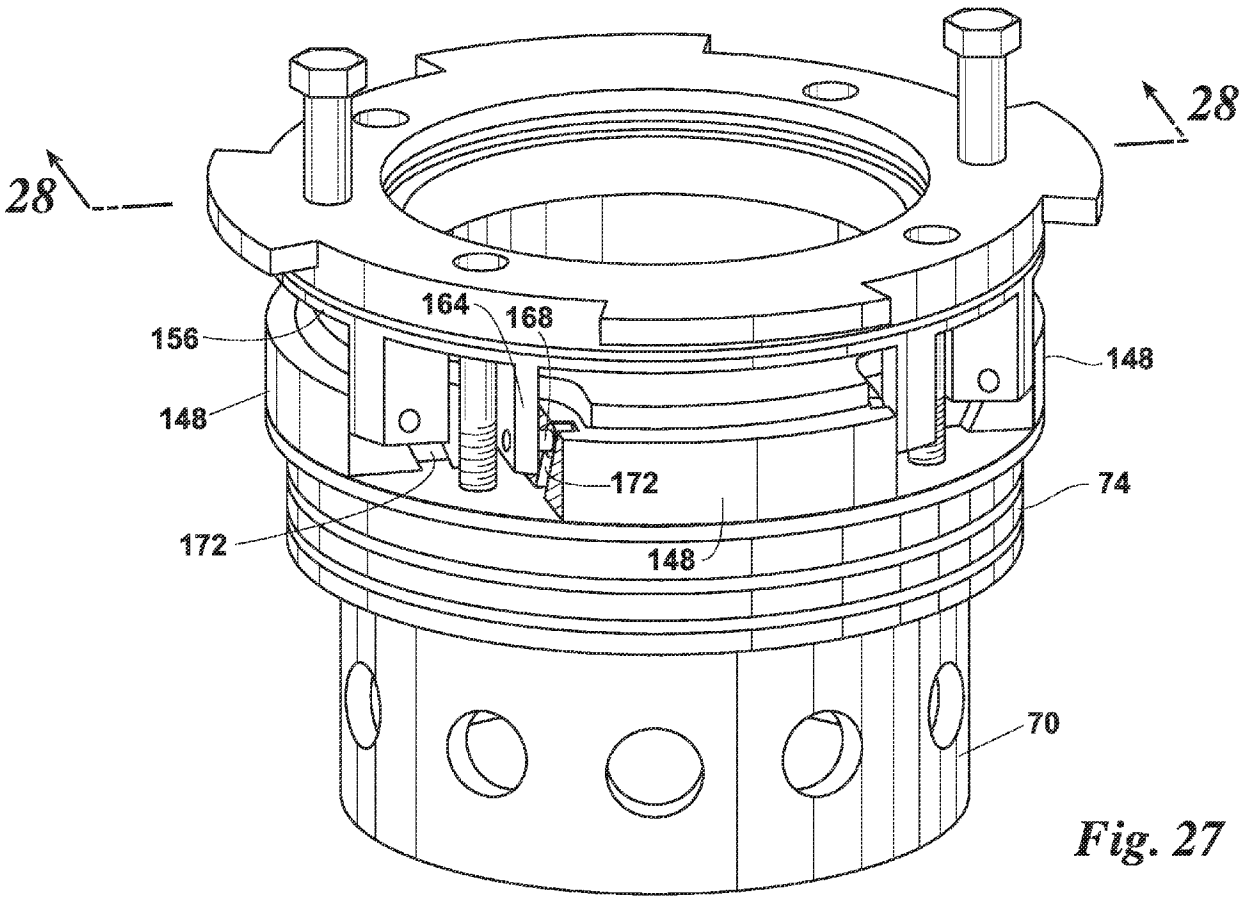
FIG. 27 is a perspective view similar to FIG. 24 wherein the locking members are refracted so that the sealing element can be removed.
Figure 28:
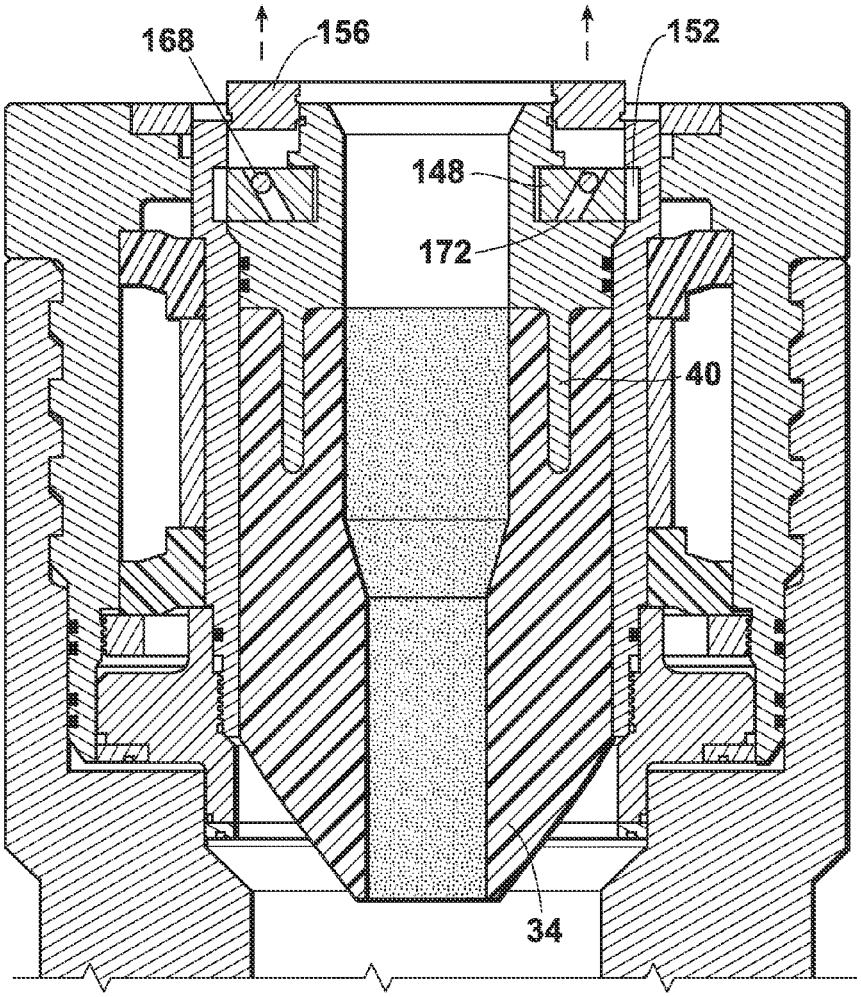
FIG. 28 is a cross-sectional view of FIG. 27, wherein locking members are in a first, non-locking position.

As shown in FIGS. 27 and 28, the control ring 156 is fastened to the block body 74 by plurality of bolts or other fasteners 160. Removal of the fasteners 160 allows the control ring 156 to be moved upwardly. The control ring 156 includes a plurality of outwardly-extending arms 164 with actuator pins 168. The actuator pins 168 are seated within one or more locking blocks 148. The actuator pins 160 are seated within angled channels 172 of the locking blocks 148. Movement of the control ring 136 away from the block body 74, biases the actuator pins 168 and causes the locking blocks 148 to move radially inward, thereby removing the locking blocks 148 from corresponding locking grooves 152. When all obstructions to longitudinal movement are removed, the block body 74 and interconnected sealing element 34 may be removed from the locking body 132, flange 136, and housing 30.

Figure 24:
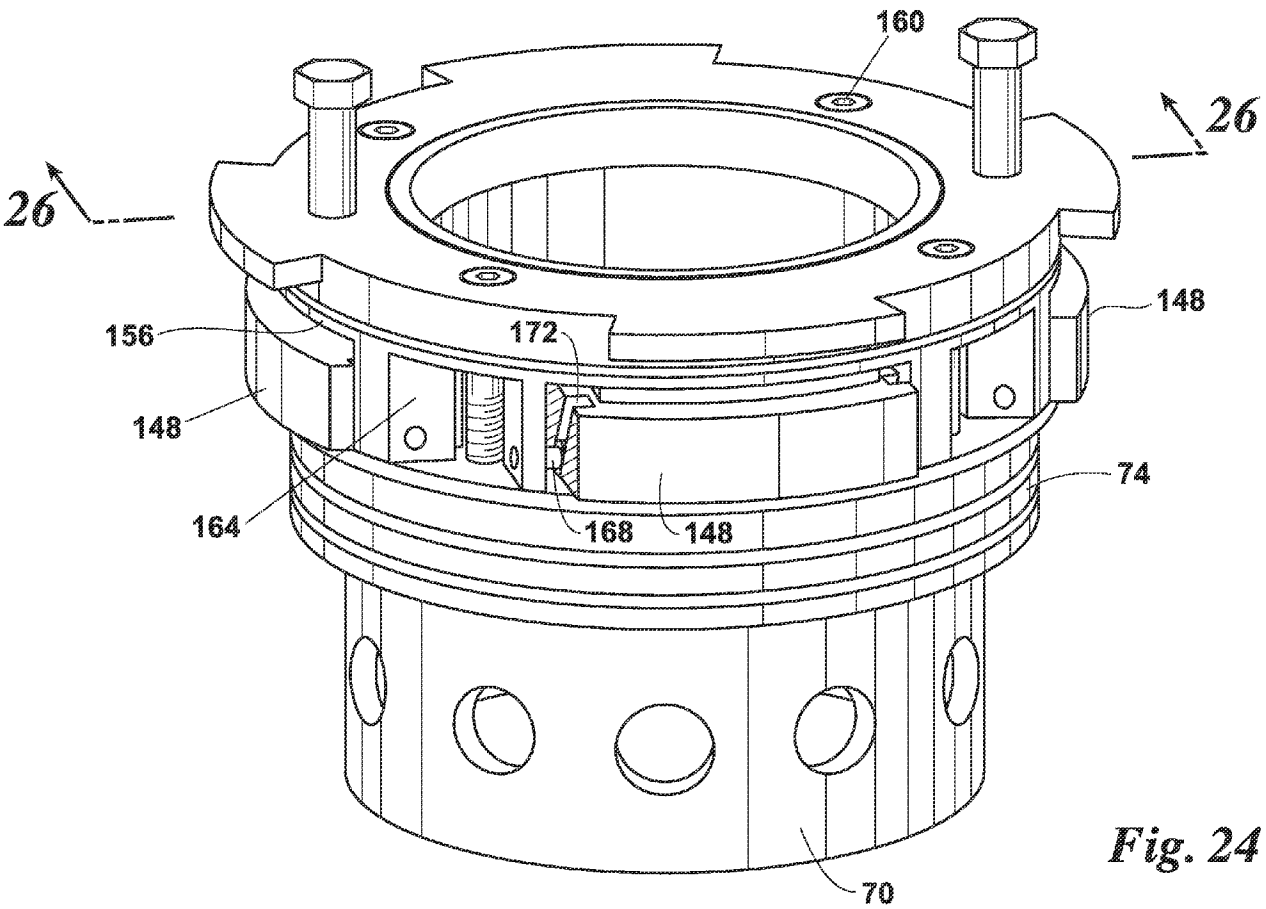
FIG. 24 is a perspective view of another embodiment of the present invention that employs a passive sealing element that is selectively locked in place by a plurality of locking members.
Figure 25:
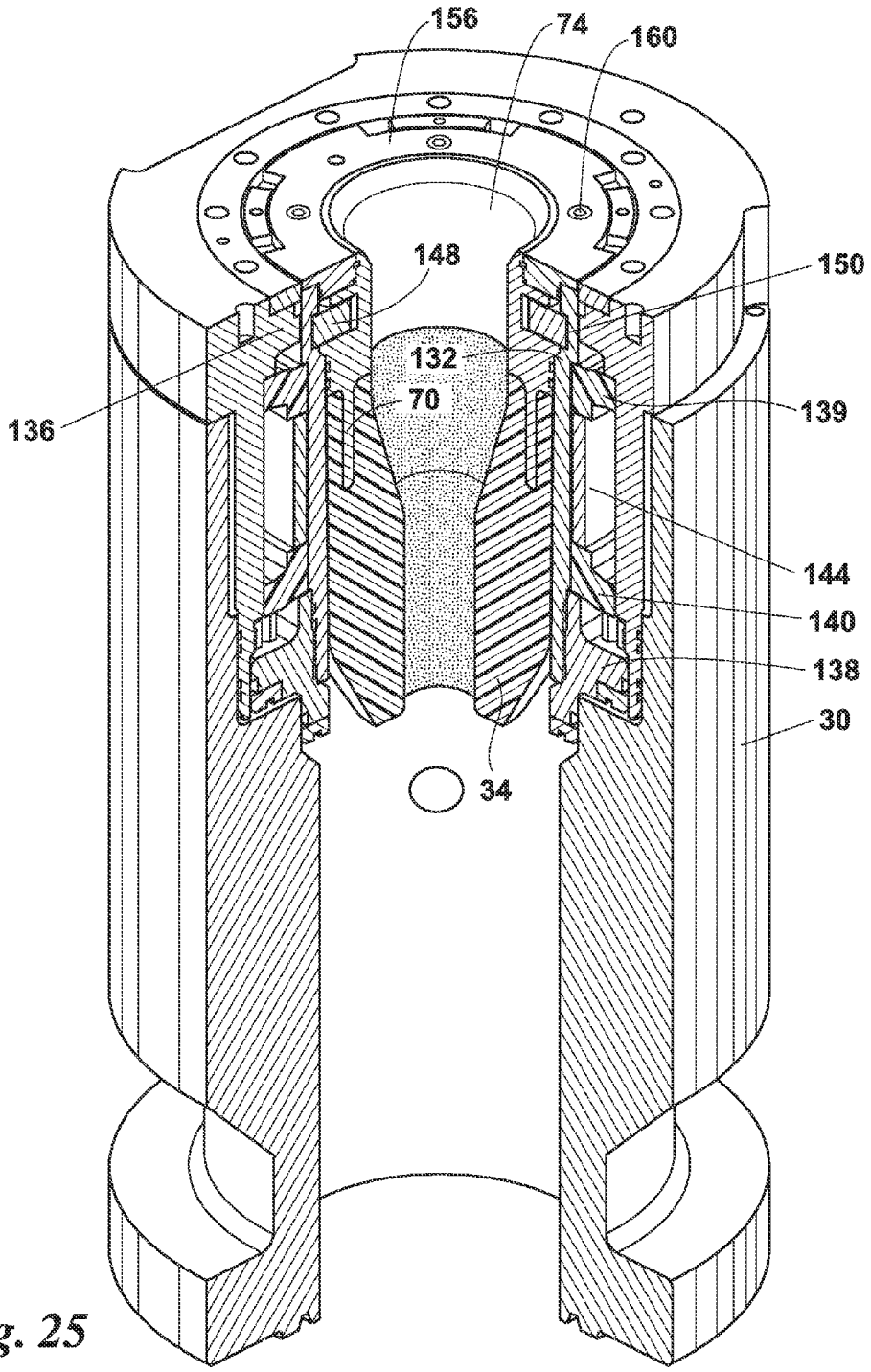
FIG. 25 is a partial perspective view of FIG. 24.
Figure 26:
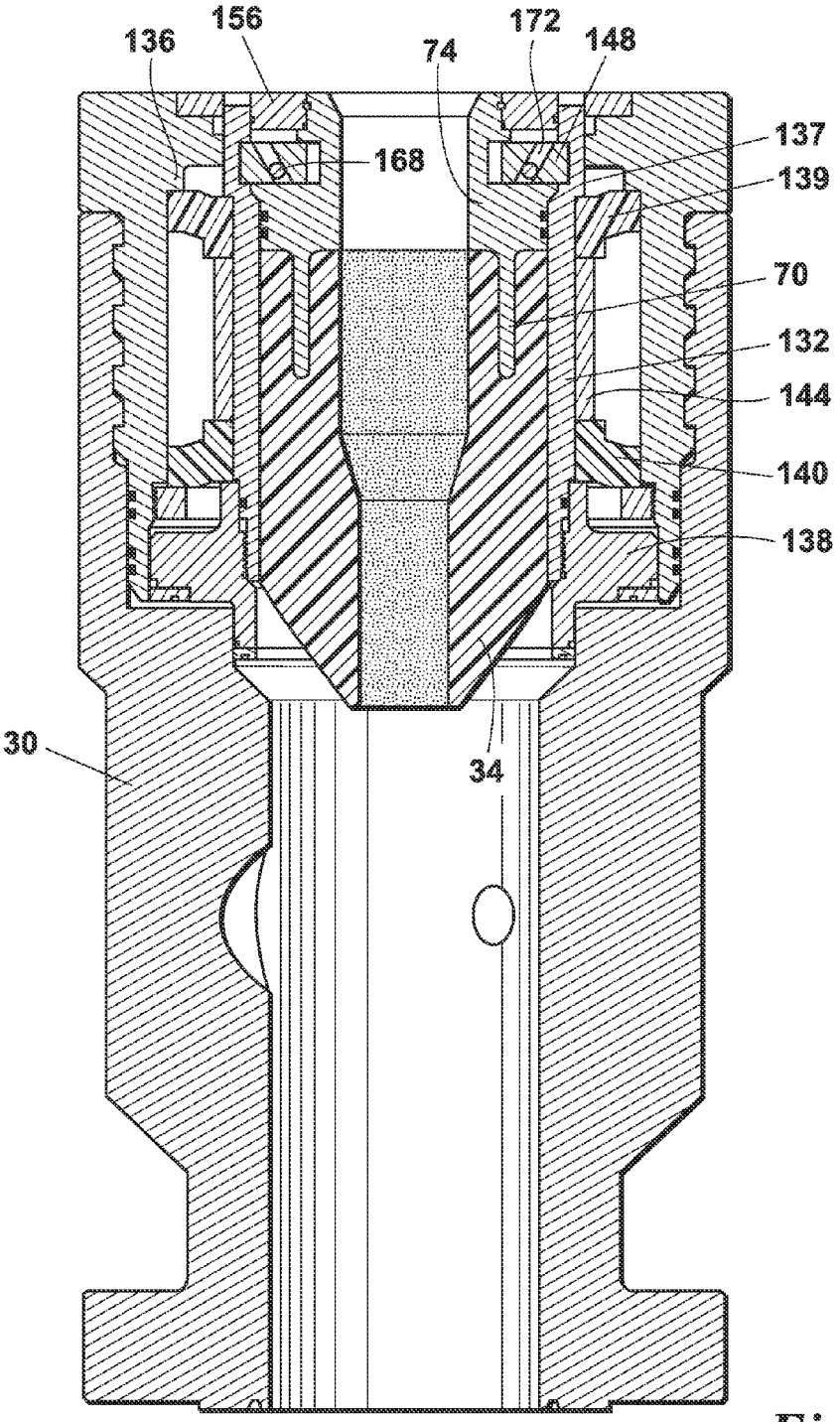
FIG. 26 is a cross-section of FIG. 24.

As shown in FIGS. 24-26, after a new sealing member 34 is placed in the housing, the control ring 156 is moved adjacent to the lock the block body 74 wherein the actuator pins 168 are placed within the angle channels 172 of the locking blocks 148. As the control ring 156 is moved closer to the block body 74, the actuator pins 168 will bias the locking blocks 140 outwardly to fit within the locking grooves 152 of the locking body 132, which fixes the location of the block body 74 with respect to the locking body 132. The fasteners 160 are added to prevent removal of the control ring 156.

Figure 29:
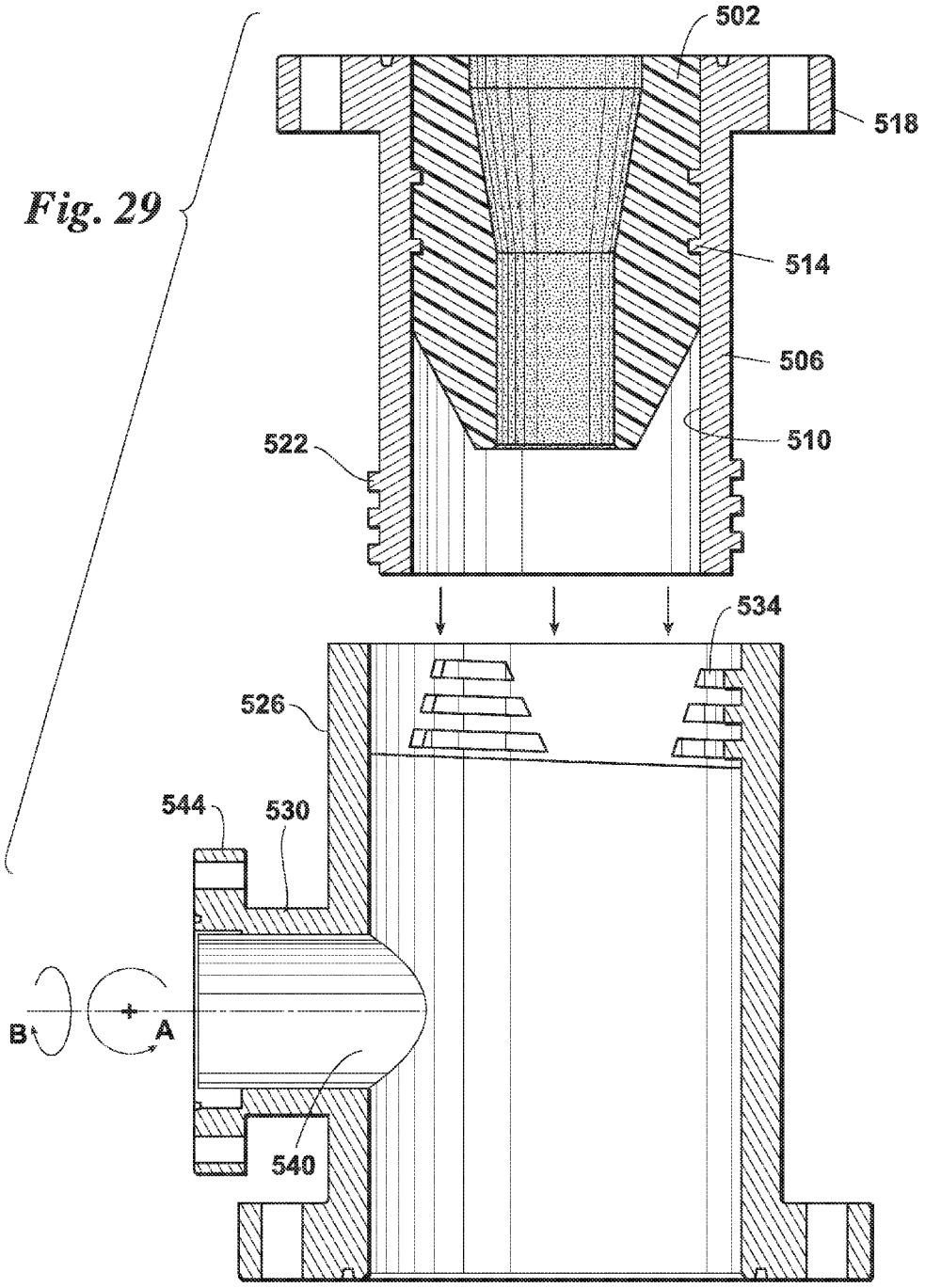
FIG. 29 is a cross-sectional view of an annular drilling device and associated spool of another embodiment of the present invention.

FIG. 29 shows another embodiment of the present invention wherein the sealing element 502 is integrated directly to the housing 506. More specifically, the sealing element 502, having a profile as described above, is molded onto an inner surface 510 of the housing 506. The housing 506 may include a plurality of ribs 514, protrusions, or other devices that help the sealing element 502 grip the inner surface 50 of the housing 506. The housing 506 of this embodiment includes a flange 518 on an upper end and a plurality of threads 522 similar to those described in FIG. 8 of the '590 patent which provide a breach lock connection with a spool 526. The threads 522 of one embodiment are tapered to facilitate stabbing the housing 506 into the spool 526. One of skill in the art will appreciate that the threads may be un-tapered as shown in the '590 patent.

To comply with various drilling regulations, prior art rotating pressure control heads require a outlet 530 that receives pressurized drilling fluid or other downhole products and delivers them to a flowline. Here, as the housing 506 and integrated sealing element 502 must be removed from the pressure control stack to replace the sealing element, but it is desirable to maintain the static connection of the outlet relative to other stationary components of the pressure control stack. Thus, the spool 526 includes corresponding threads 534 that selectively mate with the housing threads 522. Although FIG. 29 shows spool 526 having internal threads 534 and a housing 506 having external threads 522, one of skill the art will appreciate that this configuration can be reversed without departing from the scope of the invention.

In operation, when the sealing element 502 requires replacement, the drill string is removed from the pressure control stack and the housing 506 is removed. A new housing 506 with integrated sealing element 502 is quickly placed on the spool 526 and the drill string is stabbed through the housing. Again, the spool 526 remains interconnected to the pressure control stack. To ensure that the height of the combined housing and spool is not greater than that of prior art annular BOPs, embodiments of the present invention include a outlet 530 with an ovoid port 540, which allows pressure to be relieved as quick as a larger circular port.

Again, it is desirable to reduce housing 506 heat transferred from hot drilling fluid/mud or generated from friction from drill pipe interaction with the sealing element 502. This embodiment of the present invention reduces housing heat as the outlet 530 is spaced from the lower end of the sealing element 502. This feature improves flow of hot drilling fluid from the spool and away from the housing as the sealing element does not constitute fluid flow obstruction. In addition, drilling mud will fill, i.e., pack, the space between the sealing element 502 and the housing inner wall. The packed drilling mud will form an insulative barrier that protects the sealing element 506. The housing thread 522 and the spool threads 534 may also be insulated, for example coated with a material that resists heat transfer, to reduce the amount of heat transferred from the spool 526 and the housing 506. The housing 506 or spool 530 may also include cooling coils as described above or other cooling means known in the art.

In addition, it is desirable to provide a robustness connection between the spool flange 544 and the other components to which it connects. More specifically, the outlet flange 544 is connected to rigid and stationary components, wherein outside forces acting on the drill pipe stress the flange 544. Outside forces are often attributed to wave motion or other forces that act on an undersea riser, movement of the drill pipe, or vibrations generated by the spinning drill pipe. To alleviate the adverse effects of these external forces, embodiments of the present invention employ a compliant joint between the flange 544 and adjacent plumbing. For example, a joint described in U.S. Pat. No. 6,158,781, which is incorporated by reference in its entirety herein, may be employed. Such joint allows for angulation about axis and a rotation about axis B of the flange 544. Still other embodiments of the present invention employ telescoping members that allow the connection to move longitudinally along axis B.

Figure 30:
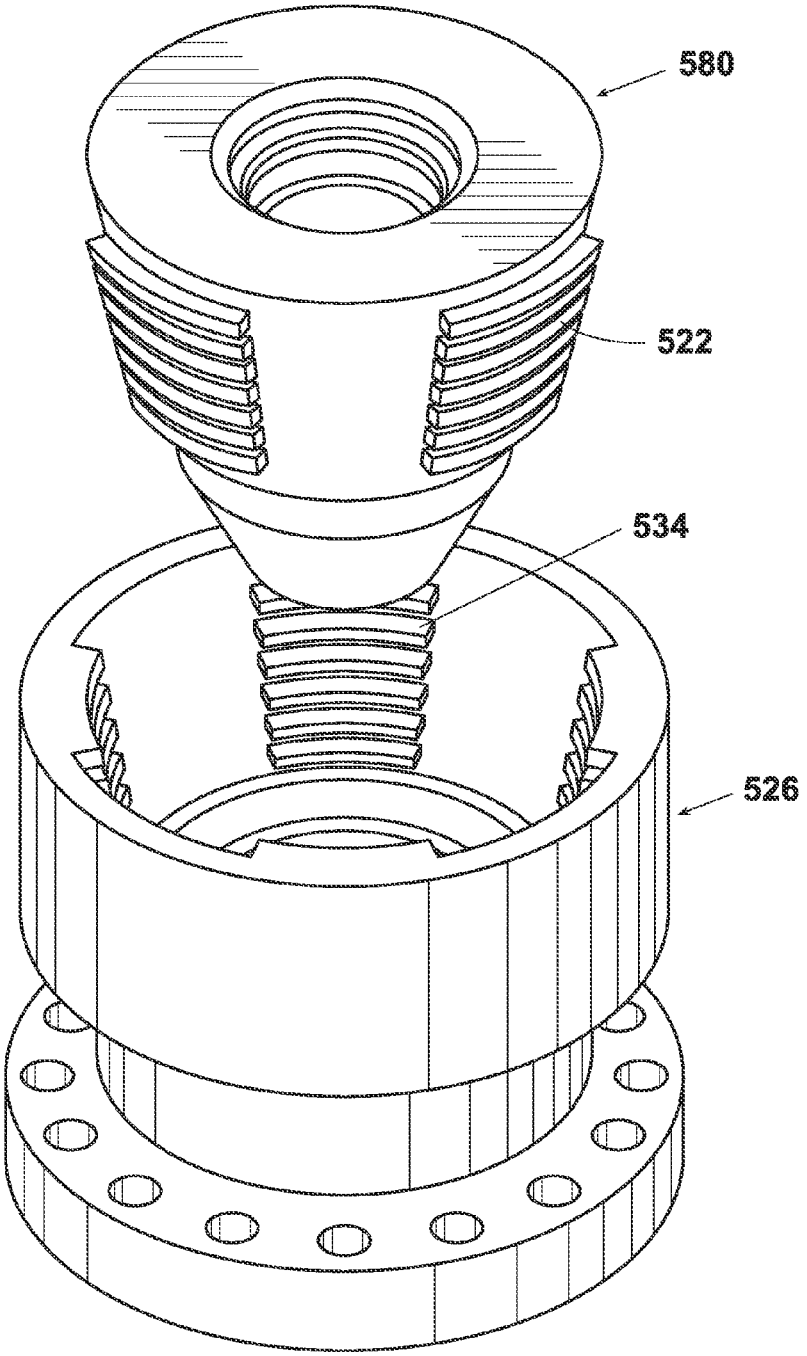
FIG. 30 is a perspective view of an annular drilling device of another embodiment of the present invention.
Figure 31:
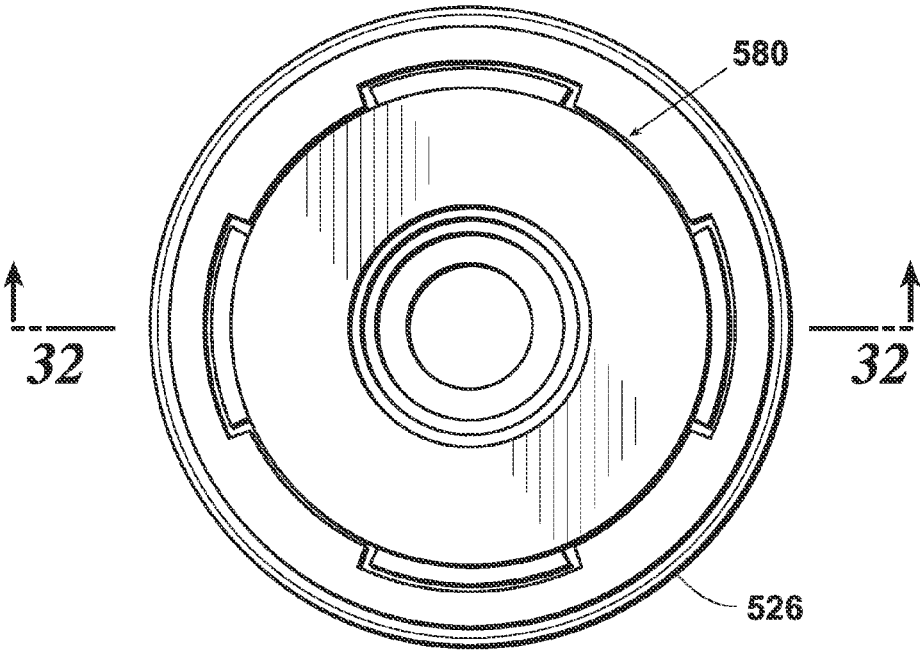
FIG. 31 is a top elevation view of FIG. 30.
Figure 32:
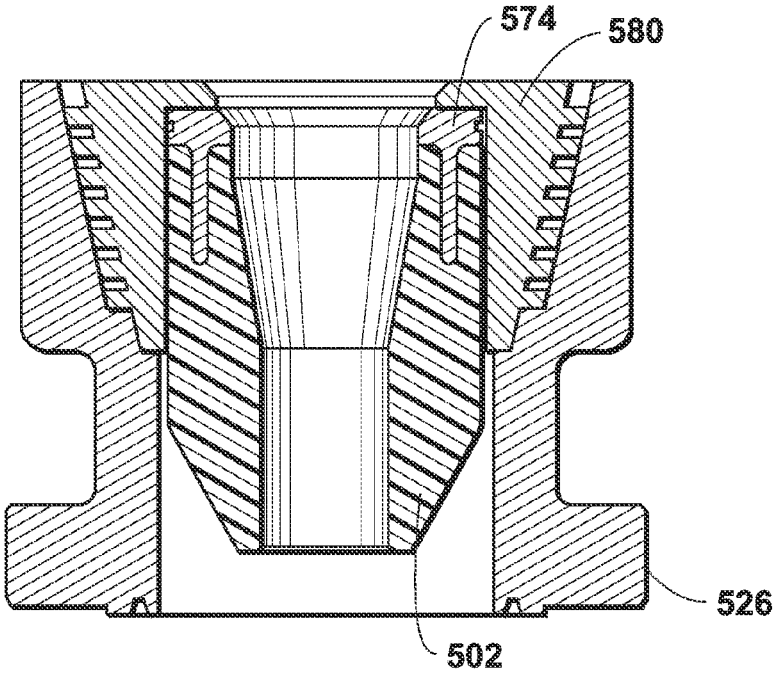
FIG. 32 is a cross sectional view of FIG. 31.

FIGS. 30-32 show an annular drilling device of another embodiment of the present invention that is comprised of a housing 580 with integrated sealing element 502. The housing 580 includes a plurality of threads 522 that selectively engage onto threads 534 of a spool 526 (outlet not shown). In some embodiments of the present invention, the threads 522 and threads 534 are tapered to facilitate interconnection of the housing and associated sealing element to the spool. The housing may be made of a metallic material wherein the sealing element 502 is made of urethane, as in the embodiments described above. The housing 580 may be tapered to facilitate insertion into the spool 526. If a non-tapered housing is used, the threads 522 and the threads 534 are tapered wherein the uppermost thread of the housing is longer than the housing lowermost thread (the spool would have threads that are a mirror image of the tapered housing threads). The sealing element 502 may be interconnected to the housing 58 by way of a block body 574. The spool 526 may have a outlet as shown in FIG. 29, or be interconnected to a separate spool with a outlet. Those of skill the art will appreciate that the housing 580 and sealing element 502 may be operatively interconnected as shown in FIGS. 10-12.

In operation, the housing 580 with associated sealing element 502 is placed within the spool 526 and rotated with respect thereto. This alignment of threads 522 and 534 secures the housing within the spool. After the sealing element 502 is worn, the housing 580 is removed and a new housing is interconnected to the spool.

Figure 33:
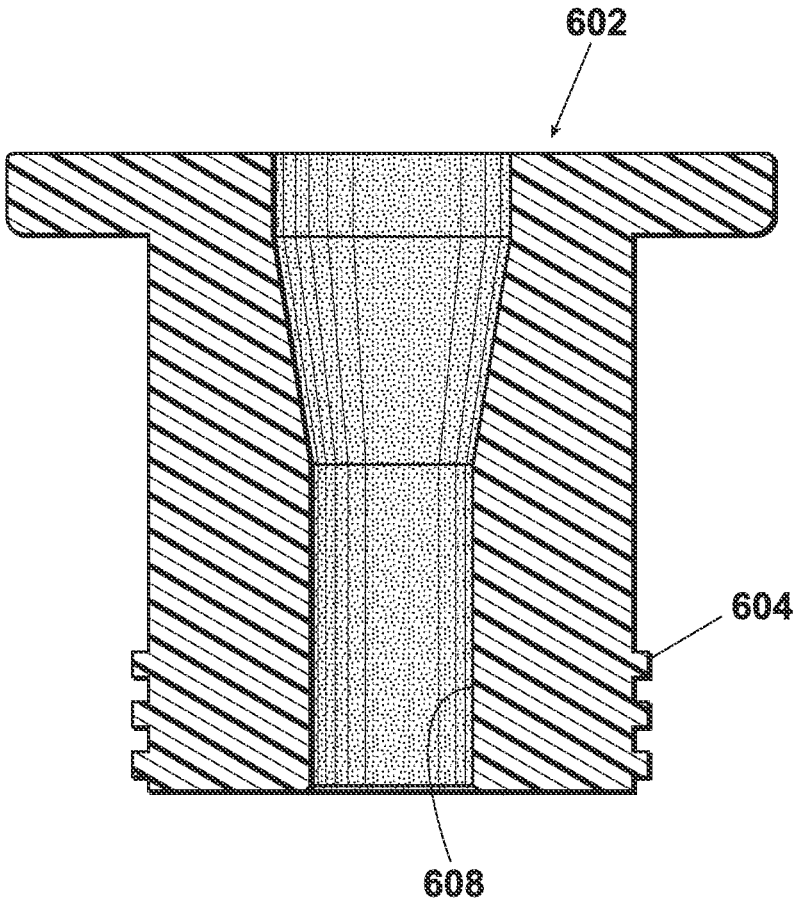
FIG. 33 is a cross-sectional view of an annular drilling device of another embodiment of the present invention.

FIG. 33 shows yet another annular drilling device 502 of the present invention. Here, the housing and the sealing element are completely integrated. For example, the sealing element and housing may be made of urethane. This configuration allows for the cooling channels contemplated by some embodiments of the present invention to be integrated. The annular drilling device 602 may include a plurality of threads 604 that engage corresponding threads of the spool as described in FIG. 29. One of skill in the art will appreciate that the threads 604 may be comprised of a helical metal ring that is molded into the annular drilling device.

In operation, when a sealing portion 608 of the annular drilling device 602 is worn, the drill string is removed and the annular drilling device 602 is removed from the spool. The used annular drilling device may be disposed of or recycled. A new annular drilling device is installed, the drill pipe is stabbed, and drilling commences. Further, the outer portions of the annual drilling device, which function as the housing of the embodiments described above, may be made of a different material, such as a urethane with a greater shore hardness wherein the inner sealing portions 608 may be made of a softer, more compliant material.

Figure 34:
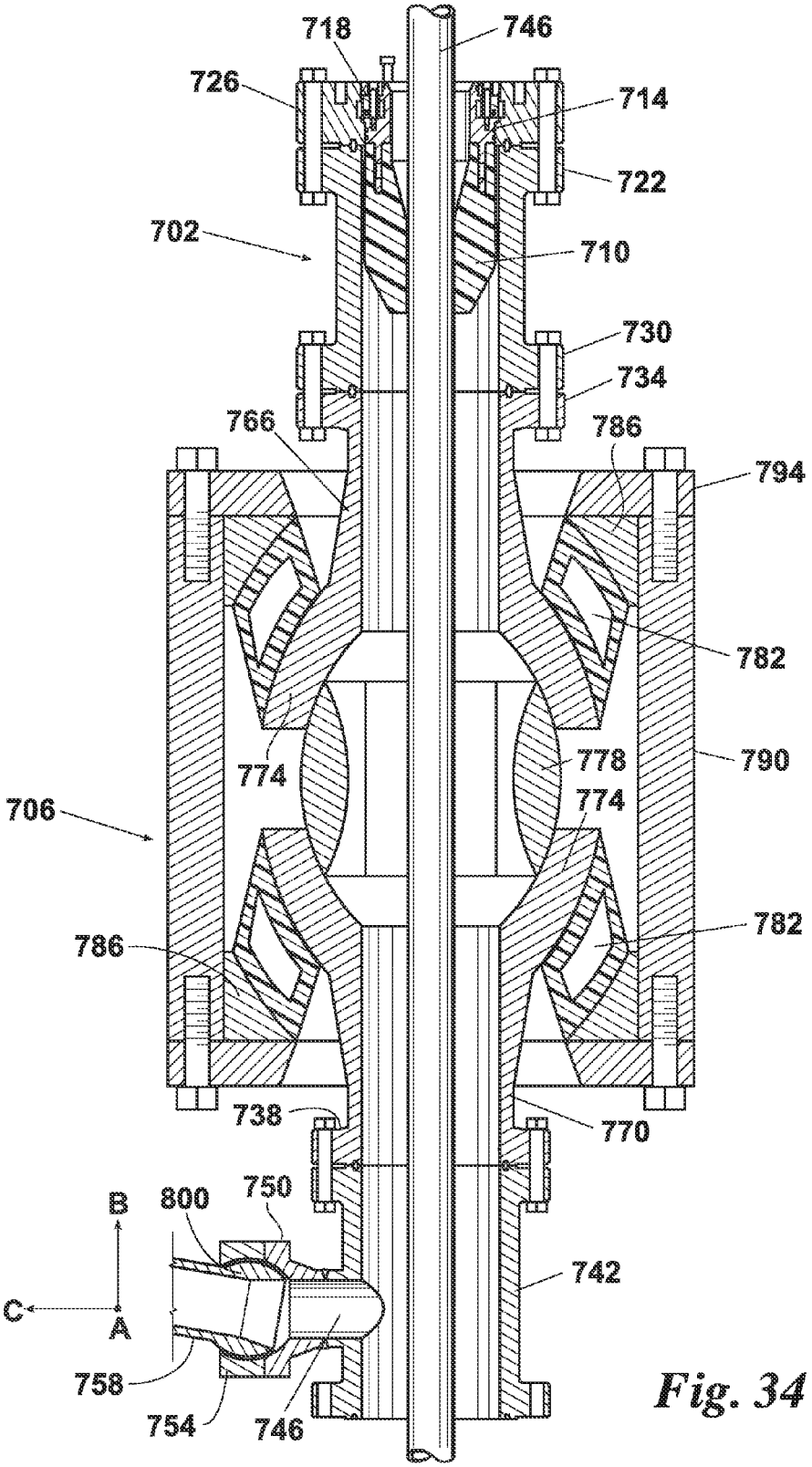
FIG. 34 is a cross-sectional view of an annular drilling device of one embodiment of the present invention that is interconnected to a flexible coupling.

FIG. 34 shows another embodiment of the present invention where an annular drilling device 702, which may be similar or identical to that shown in FIG. 6, is interconnected to a flexible coupling 706. The annular drilling device 702, which may be passive or active as described above, includes a sealing element 710 position within a body or housing. Here, the sealing element 710 is interconnected to a block body 714 selectively held in place by a locking block 718. An upper flange 722 of the annular drilling device 702 is interconnected to a flange 726 associated with the sealing element 710. The annular drilling device 702 has a lower flange 730 interconnected on an upper flange 734 of the flexible coupling 706. The flexible coupling 706 also has a lower flange 738 is interconnected to a spool 742. The spool 742 has an outlet 746 with a flange 750 designed to interconnect to a flange 754 of a flowline 758, which will be described in further detail below.

The flexible coupling 706 may be similar to, or have similar components as, those described in U.S. Pat. No. 5,615,977, which is incorporated by reference in its entirety herein. Those of skill in the art will appreciate that other flexible couplings may be employed without departing from the scope invention. The flexible coupling 706 is positioned beneath the annular drilling device 702 and compensates for bending or twisting of the pressure control stack so the annular drilling device remains generally fixed in space. Thus a drill pipe 762 positioned in the annular drilling device 702 will be ideally situated within the sealing element 710.

The flexible coupling 706 includes a tube 766 interconnected to the upper flange 734 and a tube 770 interconnected to the lower flange 738. The upper tube 766 and the lower tube 770 include flared ends 744 that receive and accommodate a transition ring 778 to create a spherical joint that allows the lower flange 738 to move, i.e. bend and twist, relative to the upper flange 734. The flared ends 774 are engaged onto upper and lower spherical bearings 782 held in place by annular interface members 786. The annular interface members 786 are housed within an outer body 790. The outer body 790 includes an upper flange 794 and a lower flange 798 that maintains a position of the spherical bearings 782 and the annular interface members 786. Again, the flexible coupling 706 shown is merely an example and those of skill the art will appreciate that other flexible or expandable members may be used without departing from the scope of the invention.

One embodiment of the present invention employs a spherical joint 800 and allows for the outlet 746 and associated spool 742 to move relative to a fixed or semi-fixed flowline 758. FIG. 34 shows a spherical joint 800 that allows the outlet to move in at least three degrees of freedom—about Axis A (out of page), about Axis B, and about Axis C. "Axis A" shall mean an axis coincident with or parallel to Axis A; "Axis B" shall mean an axis coincident with or parallel to Axis B; and "Axis C" shall mean an axis coincident with or parallel to Axis C.

Figure 35:
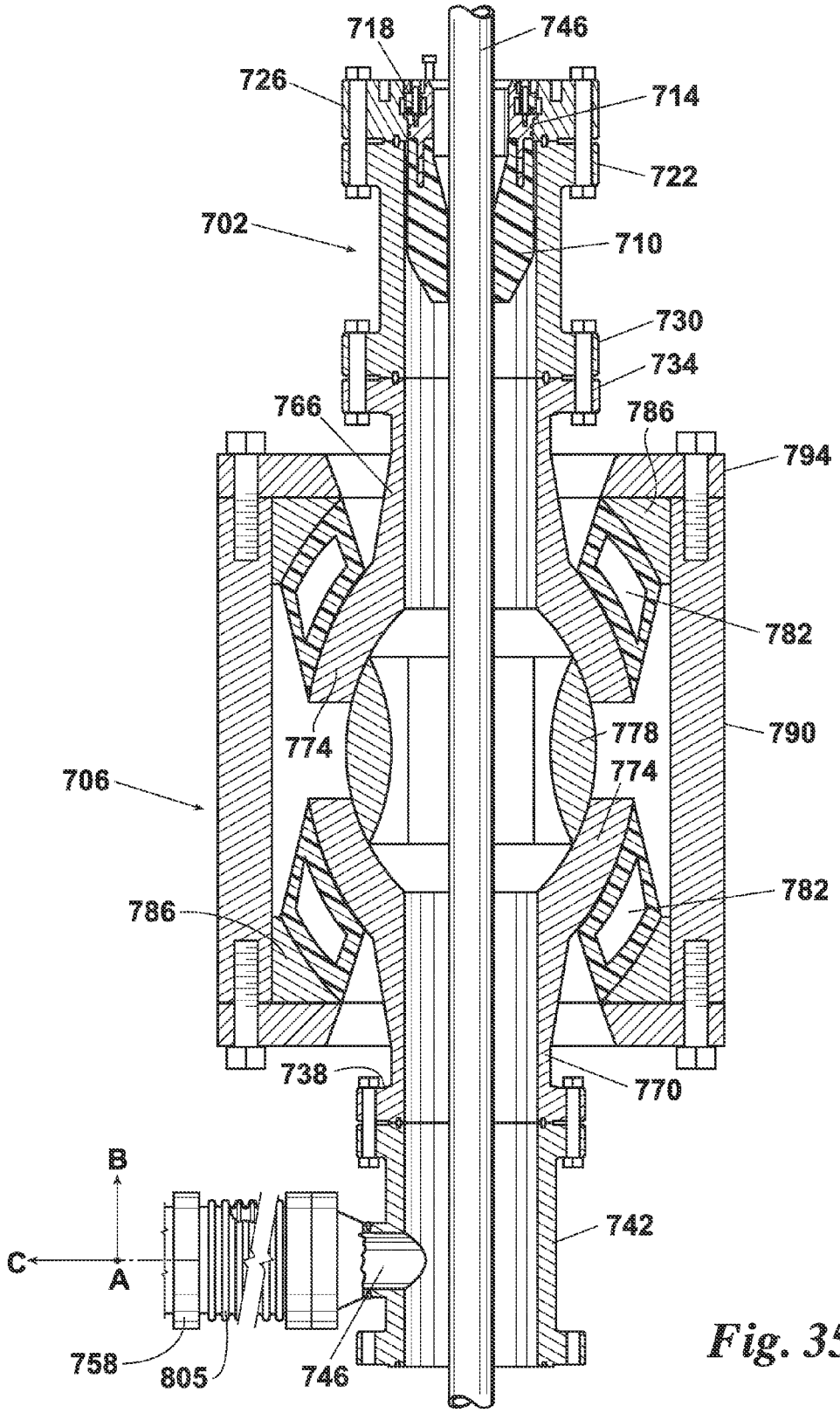
FIG. 35 is a cross-sectional view of an annular drilling device of one embodiment of the present invention that is interconnected to a flexible coupling.

FIG. 35 shows an embodiment of the present invention similar to that shown in FIG. 34. Here, however, a flexible bellows 804 is employed that provides the compliant connection between the outlet 746 and the flowline 758. The flexible bellows 804 allows the outlet 746 to move in three degrees of freedom—about Axis A (out of page), about Axis B, and along Axis C. One of skill in the art will appreciate that rotation capability around Axis C may be important, so some embodiments combine flexible bellows 804 with other movement-compensating components, such as a spherical joint shown FIG. 34. Such configuration will allow the outlet to move in at least six degrees of freedom—about Axes A and B, along Axis C, and limited motion along Axes A and B, and rotation about Axis C.

Figure 36:
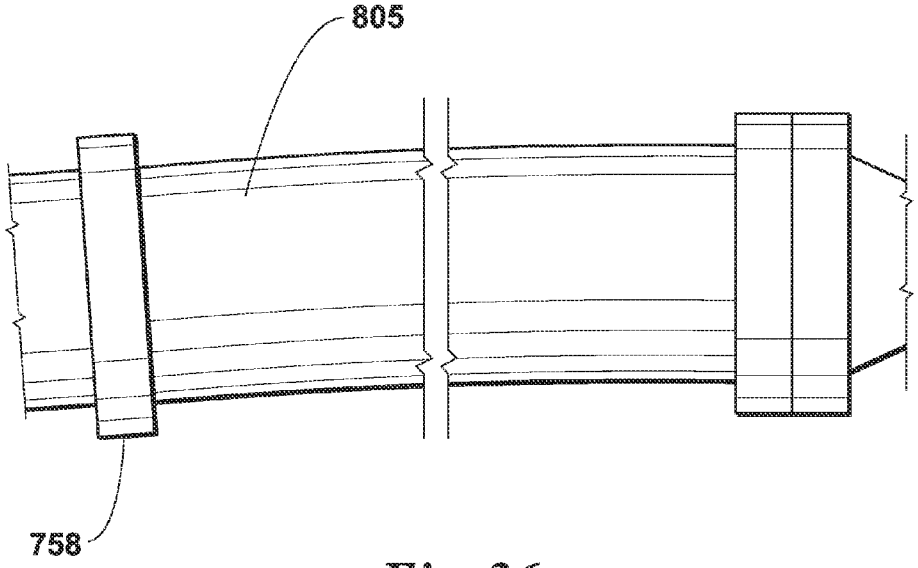
FIG. 36 is a detailed view of an embodiment similar to that shown in FIG. 35.

FIG. 36 illustrates that the embodiment of FIG. 35 can be modified to use a flexible conduit 805 instead of a flexible bellows without departing from the scope of the invention. For example, wire wrapped bellows as disclosed in U.S. Pat. No. 6,230,748, which is incorporated by reference herein, may be used. Alternatively, flexible pipe as disclosed in U.S. Pat. No. 7,445,030, which is incorporated by reference herein, may be used. The flexible conduit 805 of one embodiment is about 5 to 6 feet long, and is interconnected to the outlet and flow line with hammer unions. An example of a hammer union can be found in U.S. Pat. No. 6,899,358, which is incorporated by reference herein.

Figure 37:
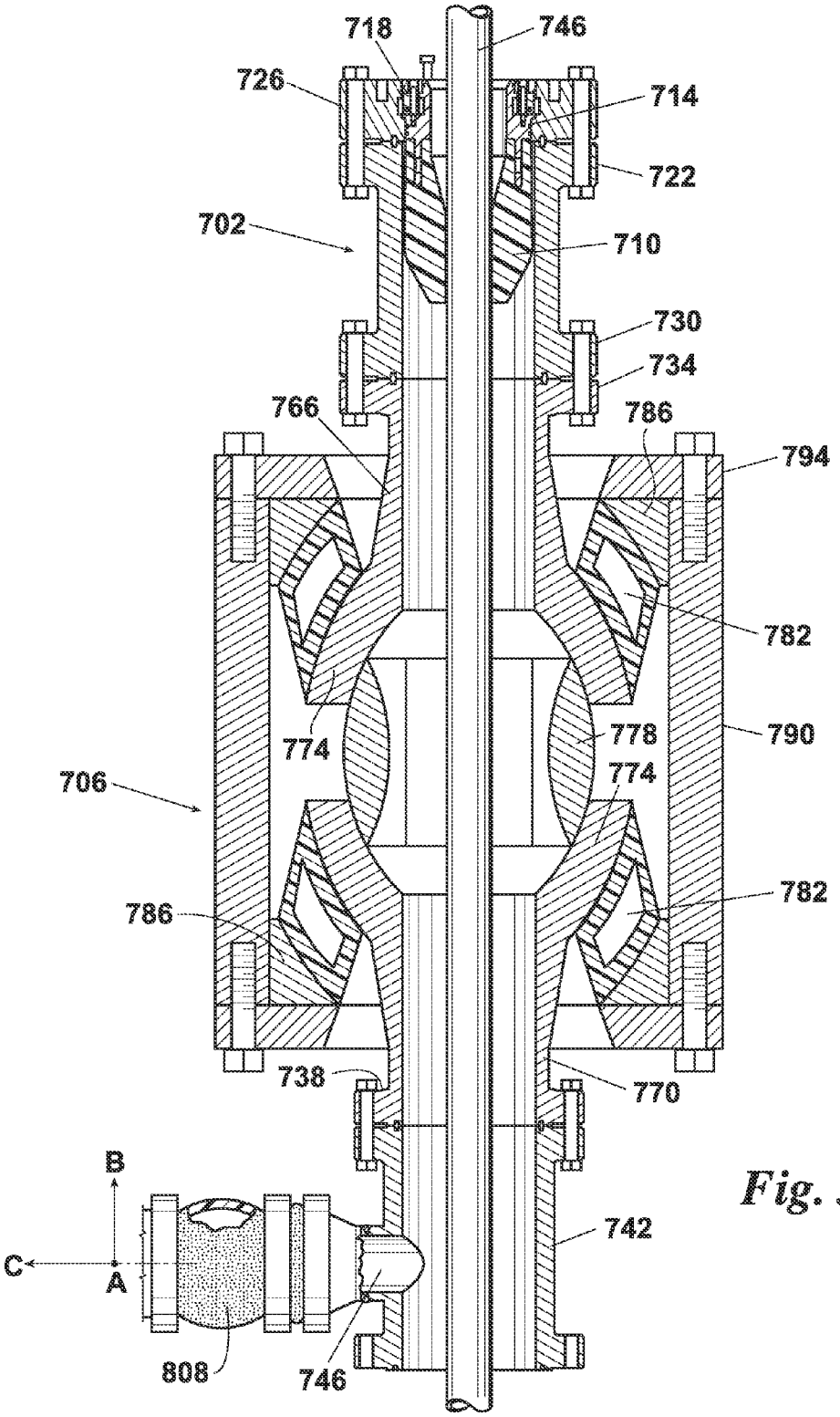
FIG. 37 is a cross-sectional view of an annular drilling device of one embodiment of the present invention that is interconnected to a flexible coupling.

FIG. 37 shows yet another embodiment of the present invention similar to FIG. 34. Here, however, a rubberized joint 808 is used, which has capabilities similar to the flexible bellows described above. Again, those of skill in the art will appreciate that another flexible member may be required to accommodate rotation about Axis C. Various types of well-known gimbal joints may be used.

Figure 38:
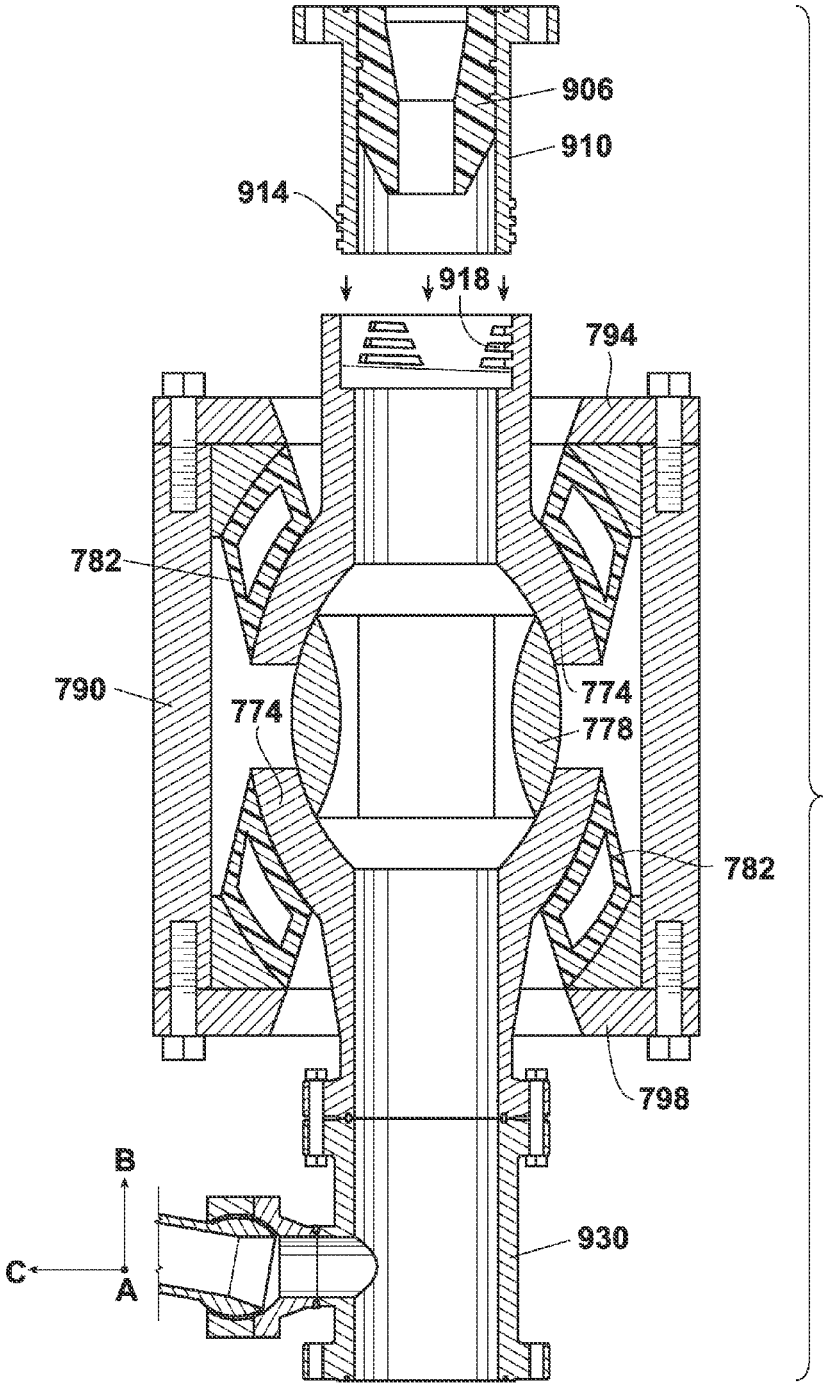
FIG. 38 is a cross-sectional view of an annular drilling device of one embodiment, which is similar to that shown in FIG. 29 that is interconnected to a flexible coupling.

FIG. 38 shows another embodiment of the present invention that employs a flexible coupling 902. The sealing element 906 shown may be similar to that shown in FIG. 29, or an active sealing element as described above. The sealing element 906 is interconnected to a housing 910 that includes threads 914 that selectively engage threads 918 of the flexible coupling 902. One of skill the art will appreciate this embodiment is very similar to the embodiments of FIGS. 34-37 but with the ability to replace the sealing element quickly.

Figure 39:
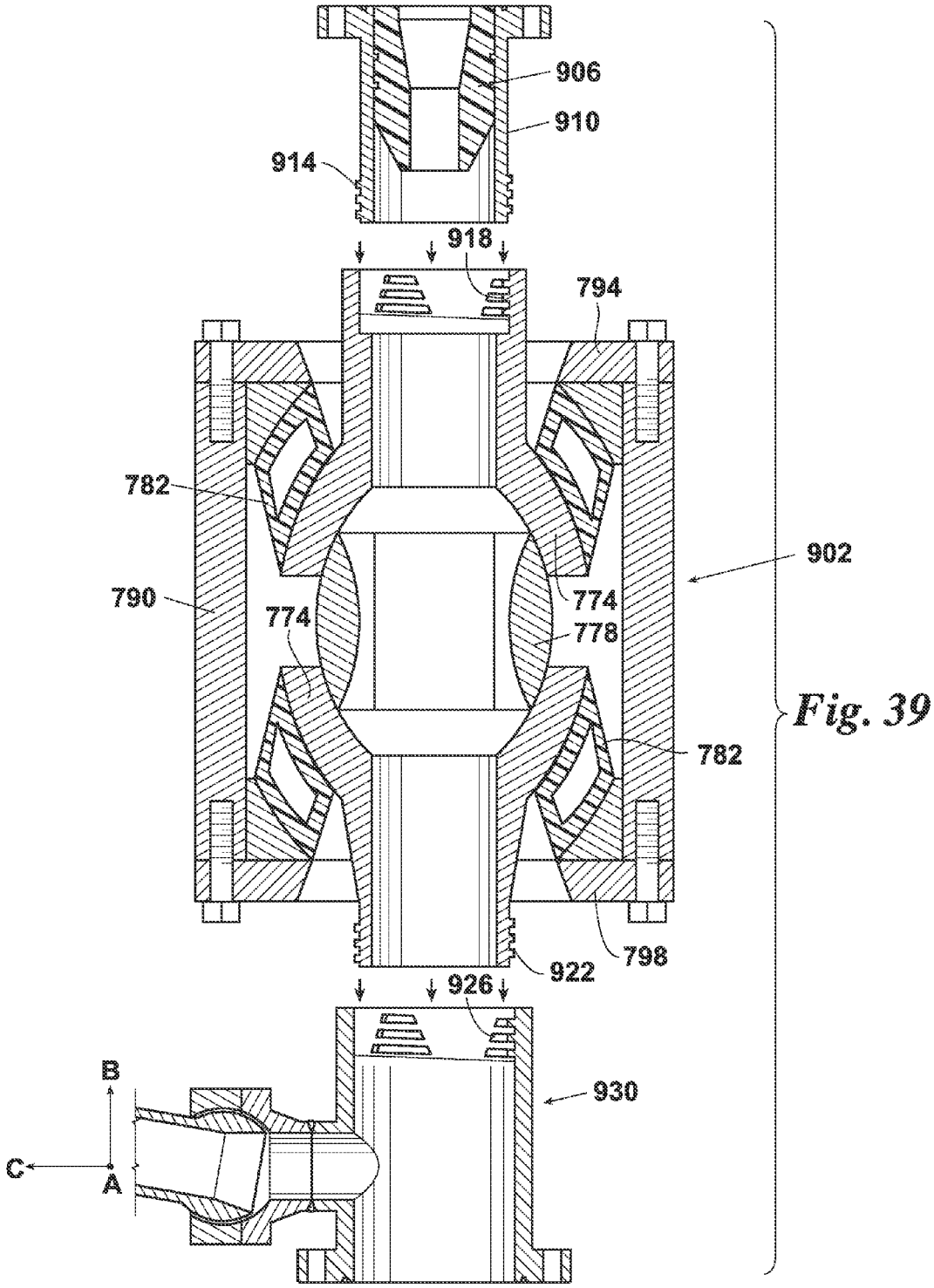
FIG. 39 is a cross-sectional view of an arrangement similar to that shown in FIG. 38, wherein the flexible coupling is threadingly interconnected to a spool.

FIG. 39 shows an arrangement similar to that shown in FIG. 38, wherein the flexible coupling also includes threads 922 at its lower end that are selectively mated to threads 926 of the spool 930.

Figure 40:
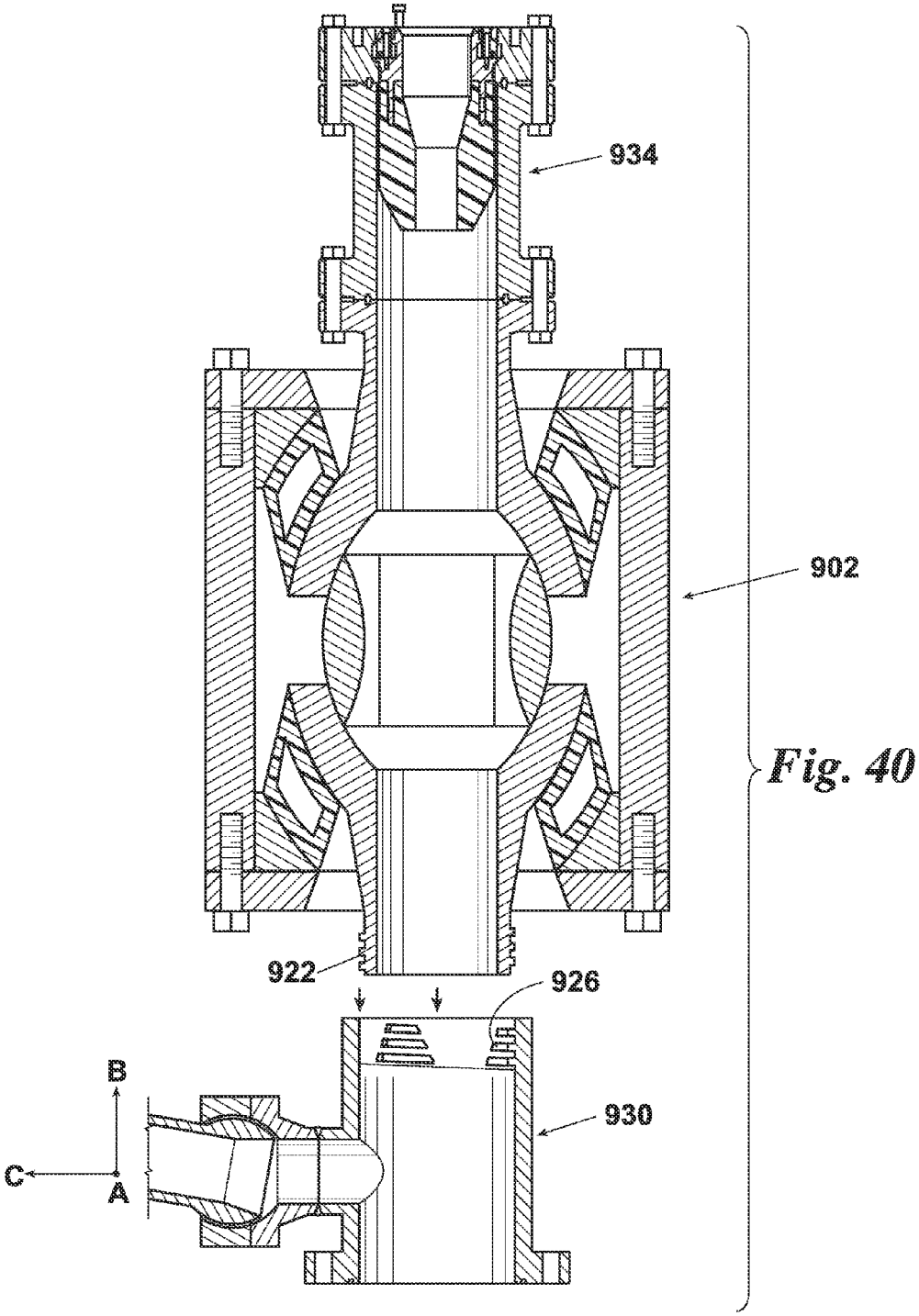
FIG. 40 is an arrangement similar to that shown in FIG. 38, wherein the flexible coupling is threadingly interconnected to a spool.

FIG. 40 shows an embodiment similar to that of FIG. 38, but wherein the annular drilling device 934 is rigidly interconnected to the flexible coupling 902. The lower end of the flexible coupling is threateningly engaged to the spool 930, which allows operators to remove and replace the annular drilling device 934 and the flexible coupling 902 in a single operation, which saves time and reduces expense.

Figure 41:
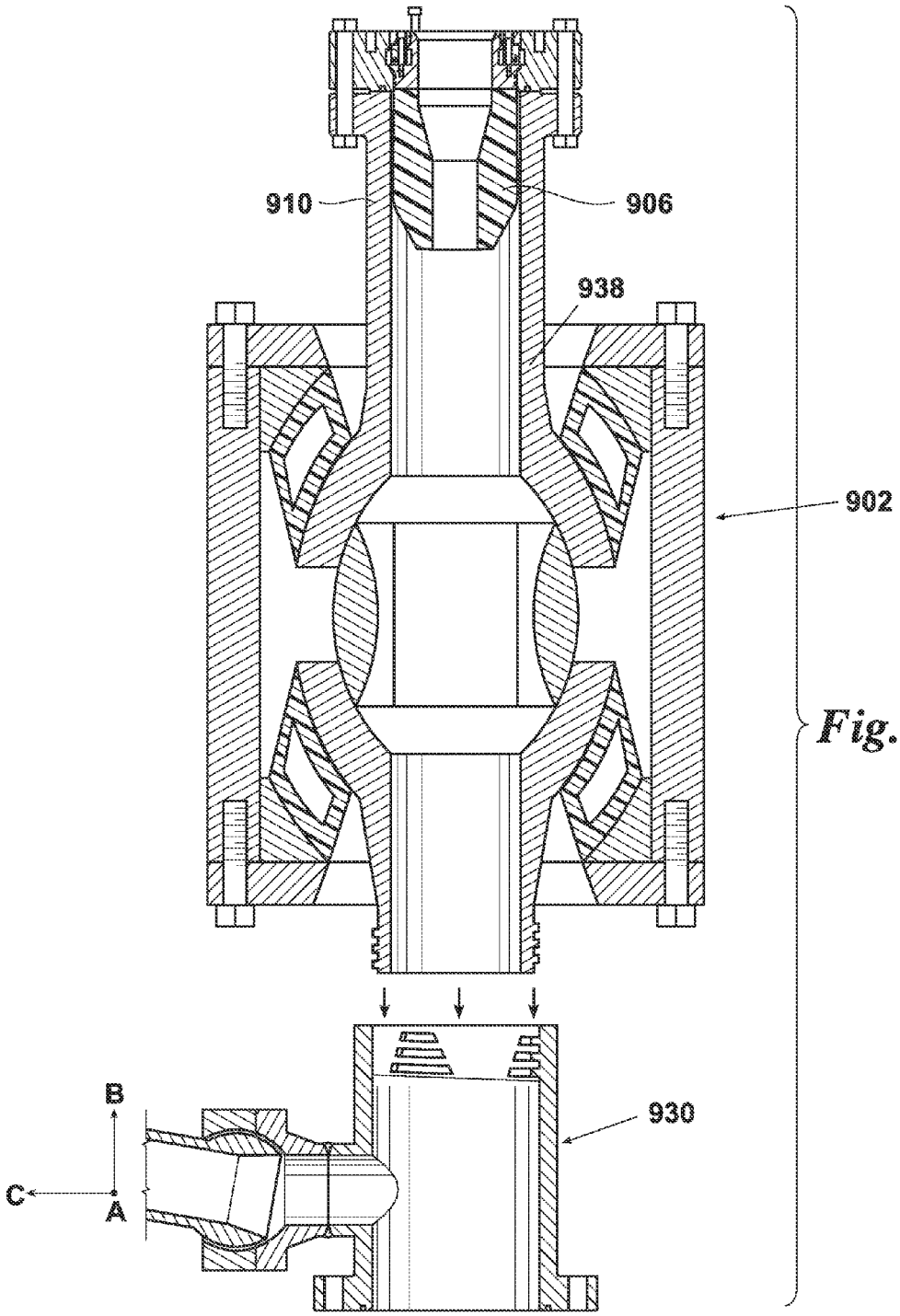
FIG. 41 is another arrangement similar to that shown in FIG. 38, wherein the annular drilling device and flexible coupling comprise a one-piece unit.

FIG. 41 takes the concept of FIG. 40 to the next level, wherein an upper tube 938 associated with the flexible coupling to is integrated directly to a housing 910 that accommodates the sealing element 906, which may be passive or active. The lower interconnection of the flexible coupling 902 to the spool 930 employs threads as described above. In operation, the operator can remove the entire one-piece unit for repair or replacement. One of skill in the art will appreciate this embodiment may use the integrated sealing element as described above regarding FIG. 29, for example.

In accordance with, or in addition to, the foregoing, this disclosure contemplates the following embodiments the present invention:

A pressure control stack comprising a first annular drilling device and an annular BOP, wherein:

1) the first annular drilling device, which has a sealing element, is quickly removable as shown in FIGS. 3-6 and 24-28; and/or 2) the sealing element is integrated into a housing as showing FIGS. 29-32; and/or 3) the sealing element is as shown in FIG. 33; and/or 4) the sealing element has a contoured surface as shown in FIG. 7-9; and/or 5) the sealing element comprises multiple pieces as showing FIGS. 10-12; and/or 6) the sealing element is cooled as shown in FIGS. 21-23; and/or 7) the first annular drilling device is passive; and/or 8) the first annular drilling device is active; and/or 9) the first annular drilling device is associated with a flexible coupling; and/or 10) the annular BOP is associate with a flexible coupling; and/or 11) an outlet is provided with a flexible interconnection to a flowline; and/or 12) a flexible couplings shown in FIGS. 34-41.

A pressure control stack that employs an annular drilling device, wherein:

1) the annular drilling device, which has a sealing element, is quickly removable as shown in FIGS. 3-6 and 24-28; and/or 2) the sealing element is integrated within a housing as showing FIGS. 29-32; and/or 3) the sealing element is as shown in FIG. 33; and/or 4) the sealing element has a contoured surface as shown in FIG. 7-9; and/or 5) the sealing element comprises multiple pieces as showing FIGS. 10-12; and/or 6) the sealing element is cooled as shown in FIGS. 21-23; and/or 7) the first annular drilling device is passive; and/or 8) the first annular drilling device is active; and/or 9) the first annular drilling device is associated with a flexible coupling; and/or 10) an outlet is provided with a flexible interconnection to a flowline; and/or 11) a flexible couplings shown in FIGS. 34-41.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A pressure control device, comprising:

a housing having a first end and a second end, said first end having a first flange and said second end having a second flange, said housing having an opening therethrough;

a sealing element positioned within said housing and interconnected to a block body that is associated with said first flange, said sealing element being a compliant member possessing a distal end with a conical outer profile, and an inner profile with a cylindrical portion, said inner profile also including an opening adapted to selectively engage a cylindrical member, wherein said cylindrical portion has a diameter that is less than an outer diameter of the cylindrical member; and wherein said sealing element remains stationary relative to an outermost surface of said housing and said sealing element is not capable of rotation when the cylindrical member is inserted and rotated within said housing.

2. The device of claim 1, wherein said inner profile includes a plurality of inwardly-extending protrusions.

3. The device of claim 2, wherein said plurality of inwardly-extending protrusions are comprised of at least one of sinusoidal ridges, equally spaced rings, and dimples.

4. The device of claim 1, wherein said inner profile includes a plurality of features formed in said compliant member.

5. The device of claim 4, wherein said plurality of features are comprised of at least one of a plurality of sinusoidal grooves, parallel grooves, and dimples.

6. The device of claim 1, wherein said pressure control device is devoid of bearings and rotating seals.

7. The device of claim 1, wherein said compliant member is made of at least one of urethane and urethane impregnated with at least one of oil, silicone, or graphite.

8. The device of claim 1, wherein said housing includes a quick disconnect coupling at said second end.

9. The device of claim 1, wherein said sealing element comprises an inner portion for engagement with the cylindrical member, wherein said inner portion rotates with the cylindrical member and said outer portion remains fixed relative to said housing.

10. The device of claim 9, wherein said inner portion has a plurality of circumferential protrusions that operatively engage corresponding grooves in said outer portion.

11. The device of claim 1, further comprising a fluid delivery coil positioned about said housing; and a heat exchanger associated with said fluid delivery coil.

12. The device of claim 1, wherein said housing includes a wall with an integrated helical coil; and a heat exchanger associated with said helical coil.

13. A pressure control device, comprising:

a housing having a first end and a second end, said housing having an opening therethrough;

a sealing element maintained within said housing, said sealing element having an opening therethrough that is adapted to selectively engage a cylindrical member; and wherein said sealing element remains static relative to an outmost surface of said housing and the sealing element is not capable of rotation when the cylindrical member is inserted and rotated within said housing; and wherein said sealing element possesses a distal end with a conical outer surface.

14. The device of claim 13, wherein said sealing element possesses a distal end with a conical outer profile.

15. The device of claim 13, wherein said sealing element possesses an inner profile with a cylindrical portion.

16. The device of claim 15, wherein said inner profile includes a plurality of inwardly-extending protrusions.

17. The device of claim 15, wherein said inner profile includes a plurality of indentations.

18. The device of claim 13, wherein said pressure control device is devoid of bearings and rotating seals.

19. The device of claim 13, wherein said sealing element is interconnected to a block body that is adapted to interconnect to a housing flange at said first end.

20. The device of claim 13, wherein said sealing element is made of at least one of urethane and urethane impregnated with at least one of oil, silicone, or graphite.

21. The device of claim 13, wherein said sealing element is directly integrated with said housing.

22. The device of claim 13, wherein said second end of said housing includes a quick disconnect coupling.

23. The device of claim 13, wherein said sealing element comprises an inner portion for engagement with the cylindrical member, wherein said inner portion rotates with the cylindrical member and said outer portion remains fixed relative to said housing.

24. The device of claim 13, further comprising a coil positioned about said housing; and a heat exchanger associated with said coil.

25. The device of claim 13, wherein said housing includes a wall with a coil; and a heat exchanger associated with said coil.

* * * * *